US011247116B2

(12) United States Patent
Crichigno

(10) Patent No.: US 11,247,116 B2
(45) Date of Patent: Feb. 15, 2022

(54) ORAL APPLIANCE SYSTEM

(71) Applicant: Nicola Crichigno, Ancaster (CA)

(72) Inventor: Nicola Crichigno, Ancaster (CA)

( * ) Notice: Subject to any disclaimer, the term of this patent is extended or adjusted under 35 U.S.C. 154(b) by 879 days.

(21) Appl. No.: 13/850,027

(22) Filed: Mar. 25, 2013

(65) Prior Publication Data

US 2014/0283848 A1 Sep. 25, 2014

(51) Int. Cl.
*A63B 71/08* (2006.01)

(52) U.S. Cl.
CPC ..... *A63B 71/085* (2013.01); *A63B 2071/088* (2013.01); *A63B 2209/08* (2013.01); *Y10T 29/49826* (2015.01)

(58) Field of Classification Search
CPC ..... A63B 2071/088; A63B 2209/08; A63B 71/085; A63B 2071/086; A63B 2009/00; A61C 5/14; A61C 7/08; A61C 7/006; A61C 8/0081; A61C 13/235; A61C 7/36; A61C 7/00; A61F 5/56; A61F 5/566; A61F 2005/563; Y10T 29/49; Y10T 29/49826
USPC ..... 128/859, 861–891; 433/6, 18–19, 189
See application file for complete search history.

(56) References Cited

U.S. PATENT DOCUMENTS 4,396,373 A 8/1983 Dellinger
4,424,030 A 1/1984 Smiley et al.
4,507,084 A * 3/1985 Blechman ..... A61C 7/006 433/7
4,511,330 A 4/1985 Smiley et al.
4,595,361 A 6/1986 Blechman et al.
4,671,767 A 6/1987 Blechman et al.
4,871,310 A 10/1989 Vardimon
(Continued)

FOREIGN PATENT DOCUMENTS

CN 2302772 1/1999
KR 10-2009-0094135 4/2012
(Continued)

OTHER PUBLICATIONS

Dellinger, Eugene et al., Active vertical corrector treatment—long-term follow-up of anterior open bite treated by the intrusion of posterior teeth, Aug. 1996, American Journal of Orthodontics and Dentofacial Orthopedics, vol. 110, Issue 2, p. 145-154 (Year: 1996).*
(Continued)

*Primary Examiner* — Alireza Nia
(74) *Attorney, Agent, or Firm* — Walter Haverfield LLP; Sean F. Mellino

(57) ABSTRACT

An oral appliance system for a human mouth comprises at least one maxillary appliance and at least one mandibular appliance that can be removably anchored to teeth of a maxilla and mandible, respectively. Respective biasing members are carried by the at least one maxillary appliance and the at least one mandibular appliance. When the at least one mandibular appliance is anchored to the human mandible and the at least one maxillary appliance is anchored to the human maxilla of a common jaw, the respective biasing members act between the at least one maxillary appliance and the at least one mandibular appliance to urge the at least one mandibular appliance inferiorly and anteriorly away from the at least one maxillary appliance with a force between about 250 grams at contact and about 1200 grams at contact.

20 Claims, 31 Drawing Sheets

(56) References Cited

U.S. PATENT DOCUMENTS

| | | | | |
|---|---|---|---|---|
| 5,152,301 | A | 10/1992 | Kittelsen et al. | |
| 6,062,855 | A | 5/2000 | Karlin | |
| 7,172,468 | B2 | 2/2007 | Nishide | |
| 9,144,512 | B2 * | 9/2015 | Wagner | A61C 7/006 |
| 2007/0224567 | A1 * | 9/2007 | Robson | 433/6 |
| 2007/0283967 | A1 * | 12/2007 | Bailey | A61F 5/566 128/848 |
| 2008/0178892 | A1 * | 7/2008 | Haduong | A61F 5/566 128/845 |
| 2008/0199824 | A1 | 8/2008 | Hargadon | |
| 2012/0231932 | A1 | 9/2012 | Rafih et al. | |

FOREIGN PATENT DOCUMENTS

| | | | | |
|---|---|---|---|---|
| WO | WO 2003/011198 | A1 | 2/2003 | |
| WO | 2012034191 | A1 | 3/2012 | |
| WO | WO 2012034191 | A1 * | 3/2012 | A61C 7/006 |
| WO | 2012158368 | A1 | 11/2012 | |
| WO | WO 2013/045892 | A1 | 4/2013 | |

OTHER PUBLICATIONS

Falgoust, M; "Neuromuscular Mouth Guard draws performance debate;" USA Today; Nov. 17, 2009 (http://usatoday30.usatoday.com/sports/2009-11-16-neuromuscular-mouthguard-cover_N.ht).

Amis, T., et al.; "Influence of Intra-oral Maxillary Sports Mouthguards on the airflow dynamics of oral breathing;" Med. and Science in Sports and Exercise; Feb. 2000; 32(2); pp. 284-290 (Abstract).

Shea, S.; "A Device to De-Stress your Workout;" The New York Times, Dec. 16, 2009; (http://www.nytimes.com/2009/12/17/health/nutrition/17fitness.html?_r=o>).

International Search Report in corresponding PCT/CA2014/000163, dated Jun. 16, 2014.

Written Opinion in corresponding PCT/CA2014/000163, dated Jun. 16, 2014.

https://en.wikipedia.org/wiki/Masticatory_force accessed on Apr. 27, 2016.

The Power of the Human Jaw; Scientific American; retrieved from http://www.scientificamerican.com/article/the-power-of-the-human-jaw/ on Apr. 27, 2016; originally published Dec. 2, 1911.

Lantanda, et al.; Novel System for Bite-Force Sensing and Monitoring Based on Magnetic Near Field Communication, Sensors (2012), 12, 11544-11558 at 11545 and 11546.

Nishigawa, et al.; Quantitative study of bite force during sleep associated bruxism; Journal of Oral Rehabilitation (2001); 28; 485-491 at 488.

http://www.webmd.com/oral-health/guide/temporomandibular-disorders-tmd, accessed on May 9, 2016.

EPO search report dated Nov. 10, 2016 in corresponding EPO App. No. 14774427.0.

Andrews; email communication from prospective expert witness dated Mar. 21, 2017.

* cited by examiner

ORAL APPLIANCE SYSTEM

TECHNICAL FIELD

The present disclosure relates to oral appliances, and more particularly to oral appliances for use in exercise.

BACKGROUND

In sport and exercise, it is known to use a "mouthguard", which is an arch-shaped appliance formed from a strong and slightly resilient material and that has tooth-mounting receptacles defined therein for securely removably receiving the teeth of either the human maxilla (upper jaw) or the human mandible (lower jaw), or in some cases the teeth of both the maxilla and the mandible. Mouthguards of this type provide a barrier between the teeth of the maxilla and the teeth of the mandible and can therefore protect the teeth from damage during exercise. For example, in the absence of a mouthguard the teeth of the maxilla and the teeth of the mandible may impact one another due to a sudden closure of the jaw or be ground against one another as a result of clenching of the jaw during intense weightlifting. However, mouthguards of this type do not promote optimal jaw position during exercise and can interfere with efficient breathing.

SUMMARY

Oral appliance systems as described herein will urge a wearer's mandible inferiorly and anteriorly away from the wearer's maxilla, placing the jaw in an anatomical position that improves breathing.

An oral appliance system for a human mouth comprises at least one maxillary appliance and at least one mandibular appliance. The at least one maxillary appliance comprises two maxillary anchor portions for removably anchoring the at least one maxillary appliance to a human maxilla at least at opposed posterior segments thereof, and each maxillary anchor portion includes mounting receptacles for securely removably receiving at least an M1 maxillary molar tooth and an adjacent PM2 maxillary premolar tooth on one side of the human mouth. The at least one mandibular appliance comprises two mandibular anchor portions for removably anchoring the at least one mandibular appliance to a human mandible at least at opposed posterior segments thereof, and each mandibular anchor portion includes mounting receptacles for securely removably receiving at least an M1 mandibular molar tooth and an adjacent PM2 mandibular premolar tooth on one side of the human mouth. Biasing members are carried by the at least one maxillary appliance and the at least one mandibular appliance. When the at least one mandibular appliance is anchored to the human mandible and the at least one maxillary appliance is anchored to the human maxilla of a common jaw, the biasing members act between the at least one maxillary appliance and the at least one mandibular appliance to urge the at least one mandibular appliance inferiorly and anteriorly away from the at least one maxillary appliance with a force between about 250 grams at contact and about 1200 grams at contact. Preferably, the biasing members urge the at least one mandibular appliance inferiorly and anteriorly away from the at least one maxillary appliance with a force between about 250 grams at contact and about 1000 grams at contact, and more preferably the at least one mandibular appliance and the at least one maxillary appliance are urged away from one another with a force of between about 250 and about 900 grams at contact between the at least one mandibular appliance and the at least one maxillary appliance.

The biasing members preferably comprise at least one maxillary magnet fixedly carried by the at least one maxillary appliance and at least one mandibular magnet carried by the at least one mandibular appliance, with the at least one mandibular magnet and the at least one maxillary magnet positioned so that when the at least one mandibular appliance is received on the human mandible and the at least one maxillary appliance is received on the human maxilla of a common jaw, the at least one mandibular magnet and the at least one maxillary magnet repel one another. In some embodiments, repulsion between the at least one mandibular magnet and the at least one maxillary magnet urges the at least one mandibular appliance anteriorly relative to the at least one maxillary appliance.

In some embodiments, each maxillary anchor portion has a maxillary tether mounting and each mandibular anchor portion has a mandibular tether mounting, with the mandibular tether mountings positioned anteriorly of the maxillary tether mountings when the at least one mandibular appliance is anchored to the human mandible and the at least one maxillary appliance is anchored to the human maxilla of a common jaw. Each maxillary tether mounting is opposed to a corresponding one of the mandibular tether mountings for receiving tethers to extend between each maxillary anchor portion and its corresponding mandibular anchor portion. In certain particular embodiments, tethers may be received at the maxillary tether mountings and the mandibular tether mountings and extend between each maxillary anchor portion and its corresponding mandibular anchor portion so as to limit movement of the at least one maxillary appliance and the at least one mandibular appliance away from one another. In other particular embodiments, resilient tethers may be received at the maxillary tether mountings and the mandibular tether mountings and extend between each maxillary anchor portion and its corresponding mandibular anchor portion so as to urge the at least one mandibular appliance anteriorly relative to the at least one maxillary appliance when the at least one mandibular appliance is anchored to the human mandible and the at least one maxillary appliance is anchored to the human maxilla of a common jaw.

In some embodiments, the at least one maxillary appliance comprises two separate maxillary appliances unconnected to one another, with each maxillary appliance comprising a distinct maxillary anchor portion, and the at least one mandibular appliance comprises two separate mandibular appliances unconnected to one another, with each mandibular appliance comprising a distinct mandibular anchor portion.

In some embodiments, the at least one maxillary appliance comprises a single maxillary appliance, with the single maxillary appliance comprising a pair of opposed maxillary anchor portions connected to one another by a maxillary anterior arch link, and the at least one mandibular appliance comprises a single mandibular appliance, with the single mandibular appliance comprising a pair of opposed mandibular anchor portions connected to one another by a mandibular anterior arch link. In some such embodiments, the maxillary anterior arch link is a lingual-side maxillary anterior arch link and the mandibular anterior arch link is a lingual-side mandibular anterior arch link. In other such embodiments, the maxillary anterior arch link is a labial-side maxillary anterior arch link and the mandibular anterior arch link is a labial-side mandibular anterior arch link. In still other embodiments, the maxillary anterior arch link and the mandibular anterior arch link are each channel-shaped for receiving incisors therewithin.

In some embodiments, each maxillary anchor portion further includes an additional mounting receptacle for securely removably receiving a PM1 maxillary premolar tooth on one side of the human mouth and each mandibular anchor portion further includes an additional mounting receptacle for securely removably receiving a PM1 mandibular premolar tooth on one side of the human mouth. In such embodiments, each maxillary anchor portion may further include an additional mounting receptacle for securely removably receiving a maxillary canine tooth on one side of the human mouth and each mandibular anchor portion may further include an additional mounting receptacle for securely removably receiving a mandibular canine tooth on one side of the human mouth.

In some embodiments, each maxillary anchor portion further includes an additional mounting receptacle for securely removably receiving an M2 maxillary molar tooth on one side of the human mouth, and each mandibular anchor portion further includes an additional mounting receptacle for securely removably receiving an M2 mandibular molar tooth on one side of the human mouth. In such embodiments, each maxillary anchor portion may further include an additional mounting receptacle for securely removably receiving an M3 maxillary molar tooth on one side of the human mouth, and each mandibular anchor portion may further include an additional mounting receptacle for securely removably receiving an M3 mandibular molar tooth on one side of the human mouth.

Oral appliance systems as described above may be used in exercise applications to position a human jaw for improved airway configuration.

A method of exercising by a human person, comprises the human person installing in the human person's mouth an oral appliance system as described above, then after installing the oral appliance system, the human person engaging in exercise and, after completing the exercise, the human person removing the oral appliance system from the human person's mouth.

A method for assembling an oral appliance system comprises providing an oral appliance system of the type described above but having respective magnet receptacles carried by the at least one maxillary appliance and the at least one mandibular appliance, with magnets yet to be installed. The method further comprises installing magnets in the respective magnet receptacles, and then installing the oral appliance system in the mouth of a human person. Installing the oral appliance system comprises anchoring the at least one mandibular appliance to the human person's mandible and anchoring the at least one maxillary appliance to the human person's maxilla so that the respective magnets act between the at least one maxillary appliance and the at least one mandibular appliance to urge the human person's mandible inferiorly and anteriorly away from the human person's maxilla with a force between about 250 grams at contact and about 1200 grams at contact.

BRIEF DESCRIPTION OF THE DRAWINGS

These and other features will become more apparent from the following description in which reference is made to the appended drawings wherein.

DETAILED DESCRIPTION

In general, oral appliance systems as described herein will each comprise one or more maxillary appliances and one or more mandibular appliances, with each maxillary appliance and mandibular appliance carrying one or more biasing members arranged to cooperate with one another to urge a human jaw into a desired anatomical position when the appliance system is mounted on the teeth of a human jaw. Importantly, the oral appliance systems described herein are intended for use in exercise applications, including sports and exercise for health and physical improvement, to position the jaw for improved airway configuration to enhance breathing, and are not intended for use in orthodontic applications. As such, although the maxillary and mandibular appliances are anchored to the teeth while in use, they act on the jaw as a whole rather than on individual teeth. Moreover, rather than being left in the mouth for a relatively long period of time, the oral appliance system would be installed in the mouth shortly before the exercise begins and then removed shortly after the exercise ends so as to avoid long term impact on tooth position.

Various exemplary embodiments of oral appliance systems will now be described with reference to the Figures. In the Figures, the reference "T" denotes the human tongue. The term "facial" is used herein as an umbrella term to encompass both labial and buccal.

Figure 1A:
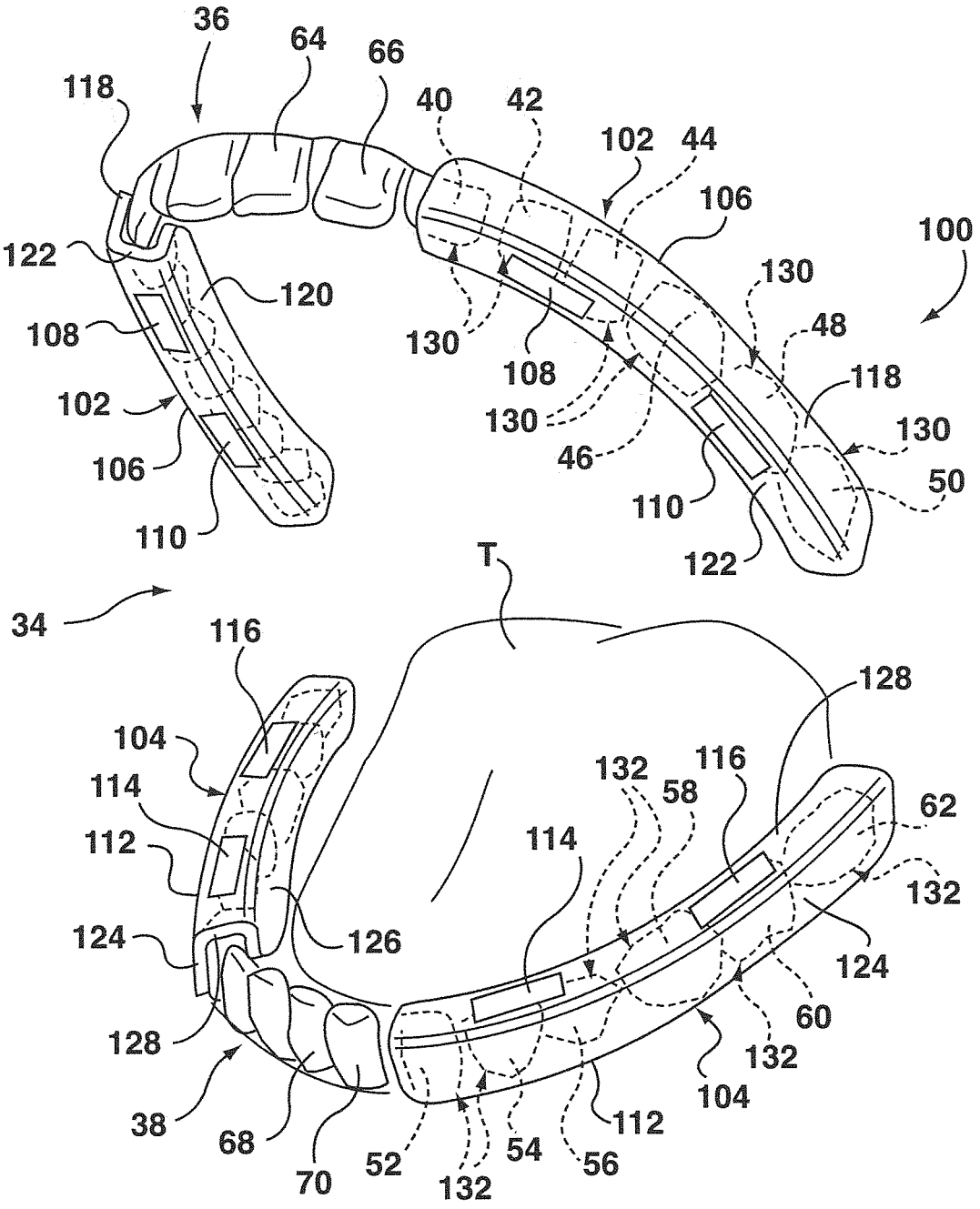
FIG. 1A is an upper front perspective view of a first exemplary oral appliance system anchored to the teeth of a human jaw, with the jaw in an exaggerated open position.
Figure 1B:
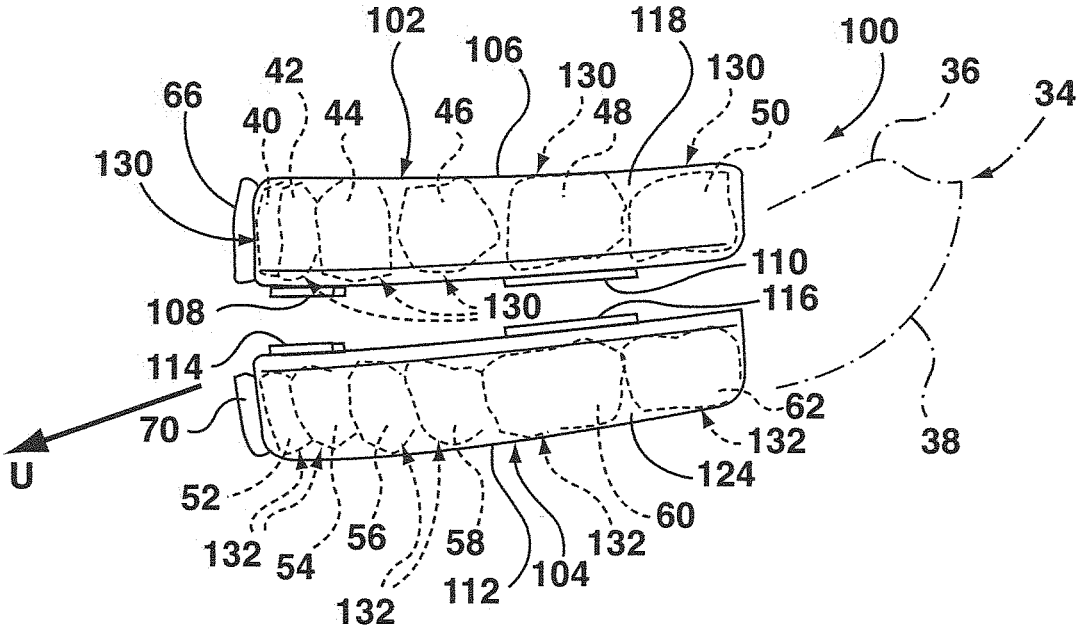
FIG. 1B is a side view of the oral appliance system of FIG. 1A anchored to the teeth of a human jaw, with the jaw in a resting position.

FIGS. 1A and 1B show a first exemplary oral appliance system, indicated generally by the reference numeral 100, anchored to the teeth of a human jaw. FIG. 1A shows the human jaw 34 in an exaggerated open position in order to facilitate illustration; a more normal or resting jaw position when the first exemplary oral appliance system is in use is shown in FIG. 1B.

The first exemplary oral appliance system 100 comprises two separate maxillary appliances 102 that are unconnected to one another, and two separate mandibular appliances 104 that are unconnected to one another. In FIGS. 1A and 1B, the oral appliance system 100 is shown mounted on a human jaw 34, with the two maxillary appliances 102 received on the maxilla 36 and the two mandibular appliances 104 received on the mandible 38. The same reference numerals are used to refer to the jaw, maxilla and mandible throughout this description.

Each maxillary appliance 102 comprises a distinct maxillary anchor portion 106 for removably anchoring the maxillary appliance 102 to a human maxilla 36 at least at opposed posterior segments thereof, as well as a pair of spaced-apart maxillary magnets, namely an anterior maxillary magnet 108 and a posterior maxillary magnet 110. Similarly, each mandibular appliance 104 comprises a distinct mandibular anchor portion 112 for removably anchoring the mandibular appliance 104 to a human maxilla mandible at least at opposed posterior segments thereof, as well as a pair of spaced-apart mandibular magnets, namely an anterior mandibular magnet 114 and a posterior mandibular magnet 116.

The maxillary magnets 108, 110 are positioned to repel the mandibular magnets 114, 116 when the maxillary anchor portions 106 and the mandibular anchor portions 112 are mounted on the teeth of a human jaw. The magnets 108, 110, 114, 116 are therefore biasing members that act between each maxillary appliance 102 and a corresponding mandibular appliance 104 to urge each maxillary appliance 102 and its corresponding mandibular appliance 104 away from one another. The magnets 108, 110, 114, 116 are arranged so that, when the oral appliance system 100 is mounted on the jaw 34, the repulsion between the maxillary magnets 108, 110 and the mandibular magnets 114, 116 not only urges each mandibular appliance 104 inferiorly away from its corresponding maxillary appliance 102, but also urges each mandibular appliance 104 anteriorly relative to the corresponding maxillary appliance 102, as shown by the arrow "U".

The maxillary anchor portions 106 and the mandibular anchor portions 112 are generally channel-shaped. Thus, the maxillary anchor portions 106 each comprise a maxillary facial sidewall 118 and a maxillary lingual sidewall 120 spaced apart from one another by a maxillary occlusal web 122, and the mandibular anchor portions 112 each comprise a mandibular facial sidewall 124 and a mandibular lingual sidewall 126 spaced apart from one another by a mandibular occlusal web 128. As can be seen in FIG. 1A, in the first exemplary oral appliance system 100, the anterior maxillary magnet 108 and the posterior maxillary magnet 110 of each maxillary appliance 102 is set into the maxillary occlusal web 122, and the anterior mandibular magnet 114 and the posterior mandibular magnet 116 of each mandibular appliance 104 is set into the mandibular occlusal web 128. In one embodiment, the magnets 108, 110, 114, 116 are encapsulated within the material of the occlusal webs 122, 128 during molding thereof. In another embodiment, the occlusal webs 122, 128 may be provided with open receptacles into which the magnets 108, 110, 114, 116 may be removably installed, for example by way of a friction fit. This will allow a dentist or other oral health professional to customize the appliances 102, 104 by installing magnets of different strengths in the receptacles, as described in greater detail below. In such an embodiment, the magnets 108, 110, 114, 116, or at least the surfaces thereof that are exposed by the open receptacles, are coated with a suitable plastic material.

The interior spaces formed by the maxillary facial sidewall 118, maxillary lingual sidewall 120 and maxillary occlusal web 122 in each maxillary anchor portion 106 define maxillary mounting receptacles 130 for securely removably receiving a maxillary canine tooth 40, a maxillary first premolar (PM1) tooth 42, a maxillary second premolar (PM2) tooth 44, a maxillary first molar (M1) tooth 46, a maxillary second molar (M2) tooth 48 and a maxillary third molar or wisdom (M3) tooth 50. Thus, in the first exemplary oral appliance system 100 shown in FIGS. 1A and 1B, the maxillary anchor portions 106 do not include receptacles for the maxillary central incisor tooth 64 or the maxillary lateral incisor tooth 66, which are exposed. Similarly, the interior spaces formed by the mandibular facial sidewall 124, mandibular lingual sidewall 126 and mandibular occlusal web 128 in each mandibular anchor portion 112 define mandibular mounting receptacles 132 for securely removably receiving a mandibular canine tooth 52, a mandibular first premolar (PM1) tooth 54, a mandibular second premolar (PM2) tooth 56, a mandibular first molar (M1) tooth 58, a mandibular second molar (M2) tooth 60 and a mandibular third molar or wisdom (M3) tooth 62. The mandibular anchor portions 112 do not include mounting receptacles for the mandibular central incisor tooth 68 or the mandibular lateral incisor tooth 70.

Figure 1C:
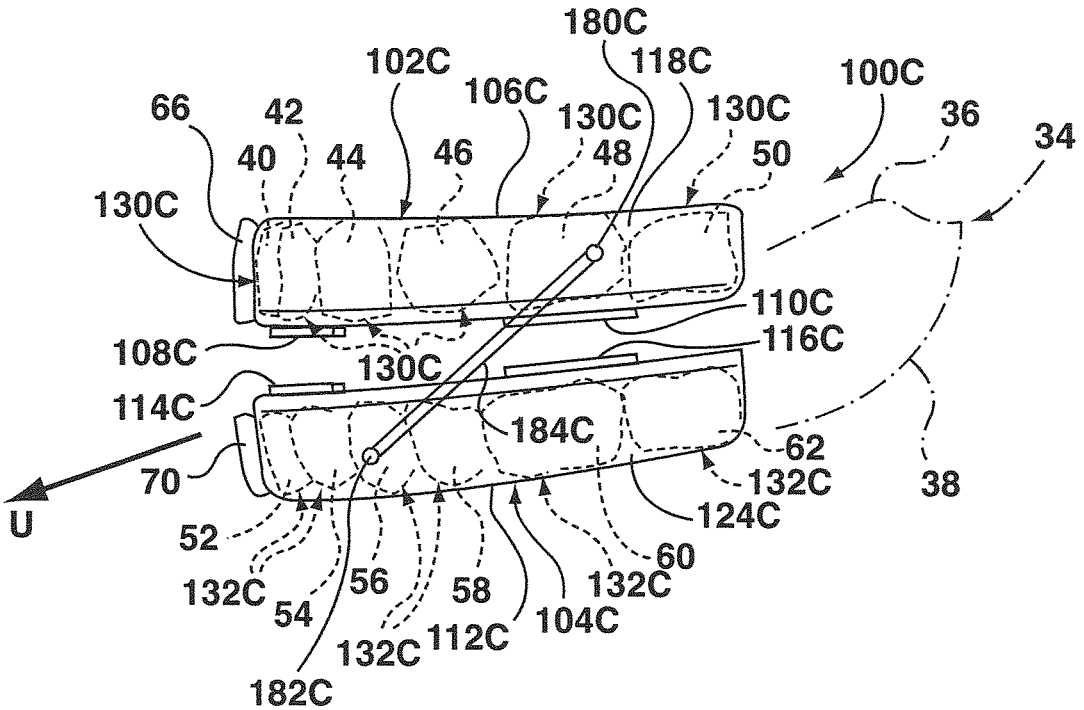
FIG. 1C is a side view showing a variant of the oral appliance system of FIG. 1A anchored to the teeth of a human jaw, with the jaw in a resting position.

FIG. 1C shows a variant 100C of the exemplary oral appliance system 100 shown in FIGS. 1A and 1B, with corresponding reference numerals referring to corresponding features except with the suffix "C". The exemplary oral appliance system 100C shown in FIG. 1C is substantially identical to the exemplary oral appliance system 100 shown in FIGS. 1A and 1B, except that each maxillary anchor portion 106C has a maxillary tether mounting 180C and each mandibular anchor portion 112C has a mandibular tether mounting 182C. As can be seen in FIG. 1C, the mandibular tether mounting 182C is positioned anteriorly of the maxillary tether mounting 180C when the two maxillary appliances 102C are received on the maxilla 36 and the two mandibular appliances 104C are received on the mandible 38 of the common human jaw 34. Each maxillary tether mounting 180C is opposed to a corresponding one of the mandibular tether mountings 182C, and tethers 184C are received at the maxillary tether mountings 180C and the mandibular tether mountings 182C and extend between each maxillary anchor portion 106C and its corresponding mandibular anchor portion 112C to limit movement of the maxillary appliances 102 and mandibular appliances 104 away from one another. Thus, the distance that can be traveled by the mandibular appliances 104 from the maxillary appliances 102 under influence of the magnets 108C, 110C, 114C, 116C, and hence the distance traveled by the mandible 38 from the maxilla 36, will be limited by the length of the tethers 184C. As such, the tethers 184C are passive tethers. The maxillary tether mountings 180C and the mandibular tether mountings 182C are smooth and rounded, and protrude as little as possible from the maxillary facial sidewall 118C and mandibular facial sidewall 124C, respectively, so as to avoid injury or irritation to the buccal surface. The maxillary tether mountings 180C and the mandibular tether mountings 182C may be, for example, short posts having flattened, rounded heads and extending from the maxillary facial sidewall 118C and mandibular facial sidewall 124C, respectively, either integrally formed therewith or embedded therein. The tethers 184C may be made of any suitable material, and may be slightly resilient or may be non-resilient.

Figure 2A:
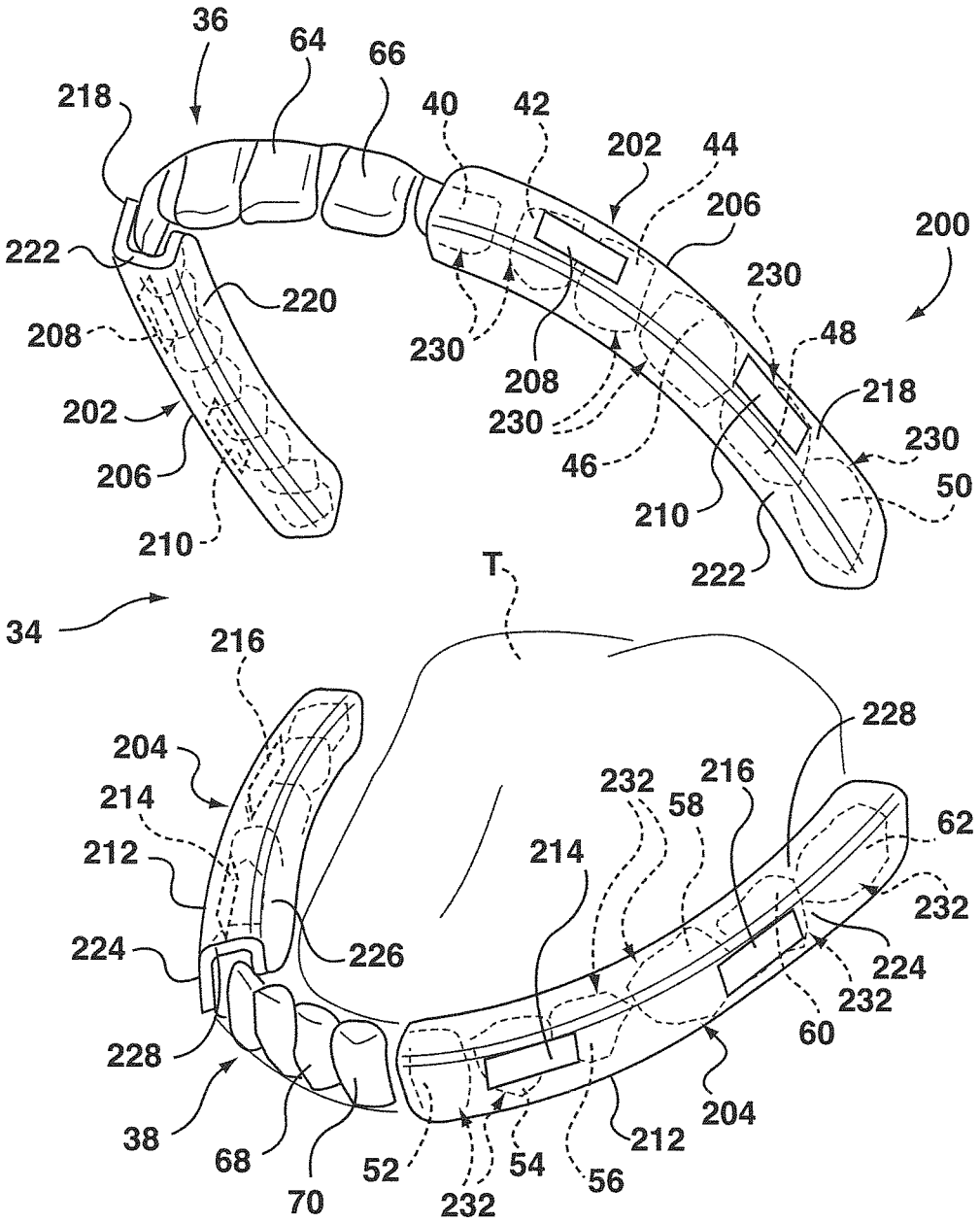
FIG. 2A is an upper front perspective view of a second exemplary oral appliance system anchored to the teeth of a human jaw, with the jaw in an exaggerated open position.
Figure 2B:
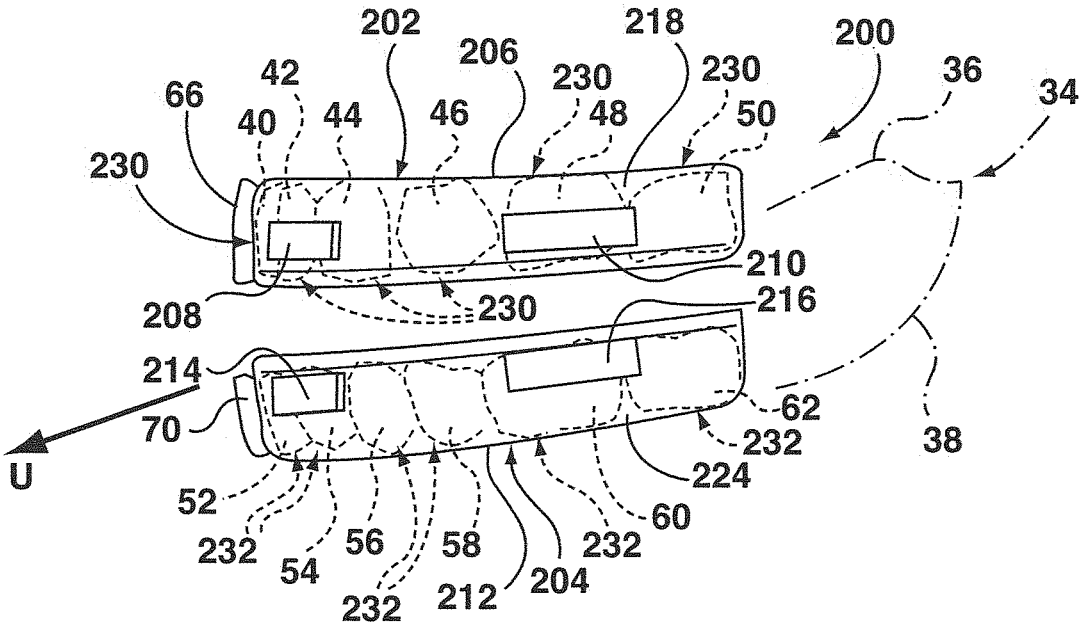
FIG. 2B is a side view of the oral appliance system of FIG. 2A anchored to the teeth of a human jaw, with the jaw in a resting position.

FIGS. 2A and 2B show a second exemplary oral appliance system, which is denoted generally by reference 200. The second exemplary oral appliance system 200 shown in FIGS. 2A and 2B is substantially identical to the first exemplary oral appliance system 100 shown in FIGS. 1A and 1B, except that in the second exemplary oral appliance system 200, the anterior maxillary magnet 208 and posterior maxillary magnet 210 of each maxillary appliance 202 are set into the maxillary facial sidewall 218 instead of the maxillary occlusal web 222, and the anterior mandibular magnet 214 and the posterior mandibular magnet 216 of each mandibular appliance 204 are set into the mandibular facial sidewall 224 instead of the mandibular occlusal web 228. Hence, corresponding reference numerals are used to refer to corresponding features, except with the prefix "2" instead of "1".

Figure 2C:
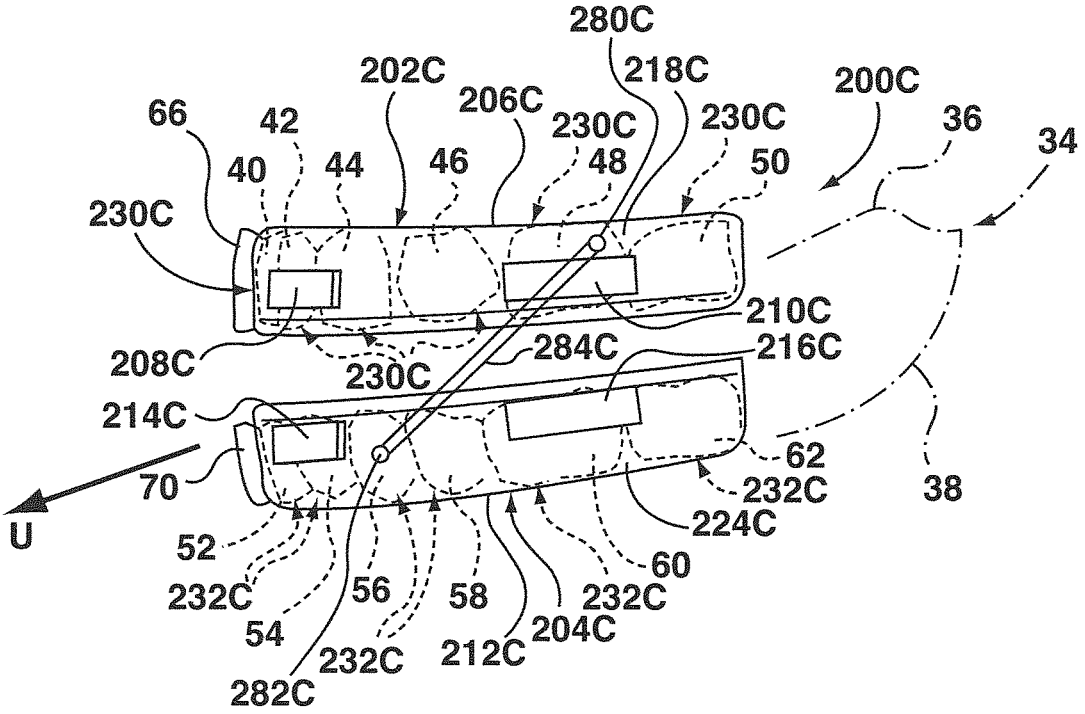
FIG. 2C is a side view showing a variant of the oral appliance system of FIG. 2A anchored to the teeth of a human jaw, with the jaw in a resting position.

FIG. 2C shows a variant 200C of the second exemplary oral appliance system 200 which includes maxillary tether mountings 280C, mandibular tether mountings 282C and tethers 284C, analogously to the variant 100C of the first embodiment 100. The same reference numerals are used to refer to features of the variant oral appliance system 200C that correspond to features of the second exemplary oral appliance system 200, except with the suffix "C".

Figure 3A:
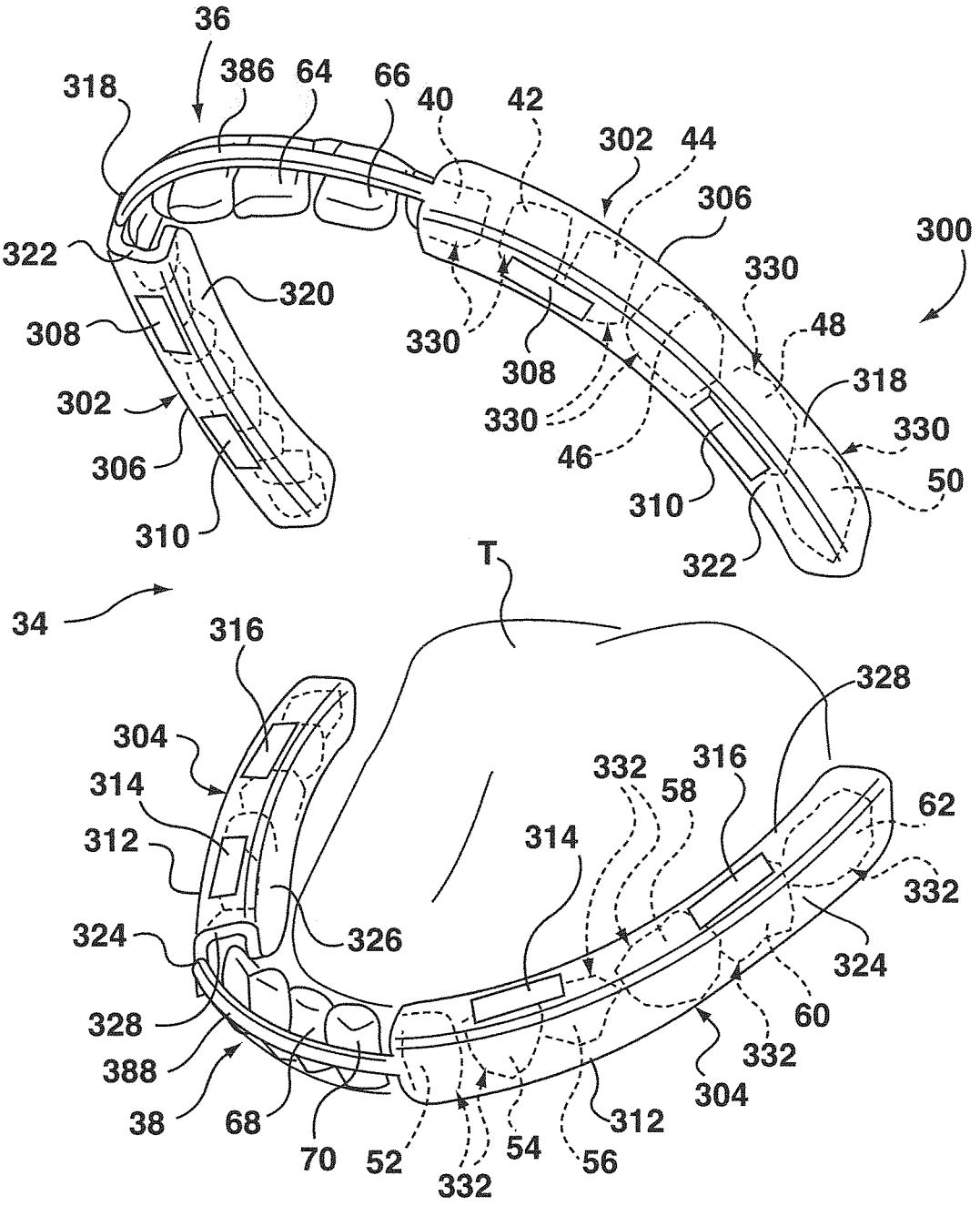
FIG. 3A is an upper front perspective view of a third exemplary oral appliance system anchored to the teeth of a human jaw, with the jaw in an exaggerated open position.
Figure 3B:
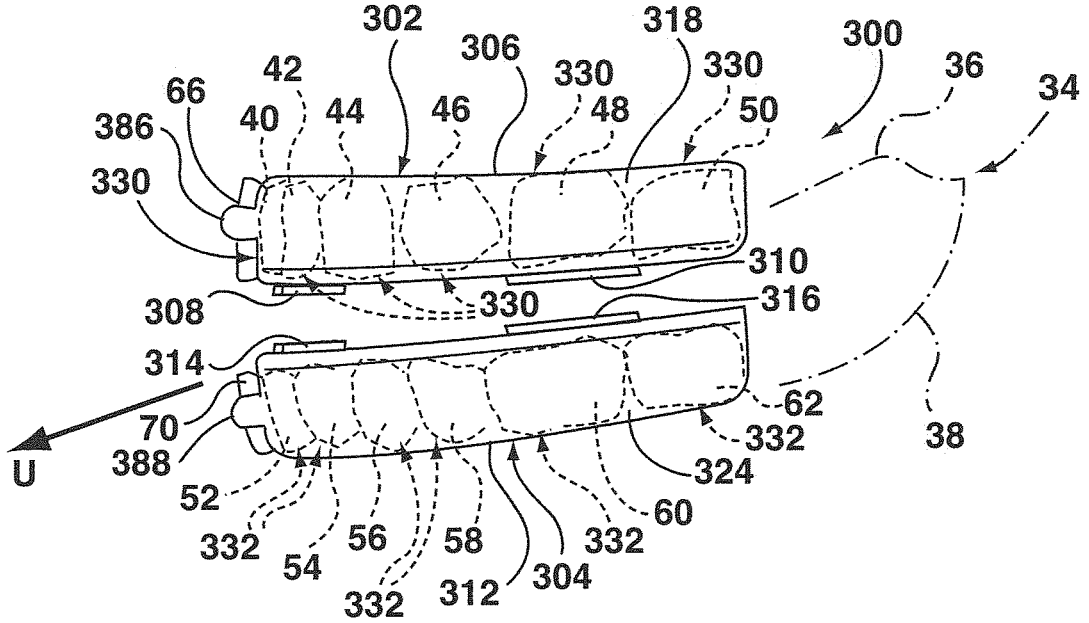
FIG. 3B is a side view of the oral appliance system of FIG. 3A anchored to the teeth of a human jaw, with the jaw in a resting position.

FIGS. 3A and 3B show a third exemplary oral appliance system 300. The third exemplary oral appliance system 300 is very similar to the first exemplary oral appliance system 100, with corresponding reference numerals used to denote corresponding features, except with the prefix "3" instead of "1". The third exemplary oral appliance system 300 differs from the first exemplary oral appliance system 100 in that it comprises only a single maxillary 302 appliance and only a single mandibular appliance 304. The single maxillary appliance 302 comprises a pair of opposed maxillary anchor portions 306 very similar to the maxillary anchor portions 106 shown in FIGS. 1A and 1B, but which are connected to one another by a labial-side maxillary anterior arch link 386. Similarly, the single mandibular appliance 304 comprises a pair of opposed mandibular anchor portions 312, very similar to the mandibular anchor portions 112 shown in FIGS. 1A and 1B, but which are connected to one another by a labial-side mandibular anterior arch link 388. When the third exemplary oral appliance system 300 is mounted on a user's teeth, the labial-side maxillary anterior arch link 386 extends across the maxillary central incisor teeth 64 and the maxillary lateral incisor teeth 66 on the labial sides thereof, and the labial-side mandibular anterior arch link 388 extends across the labial sides of the mandibular central incisor teeth 68 and the mandibular lateral incisor teeth 70.

Figure 3C:
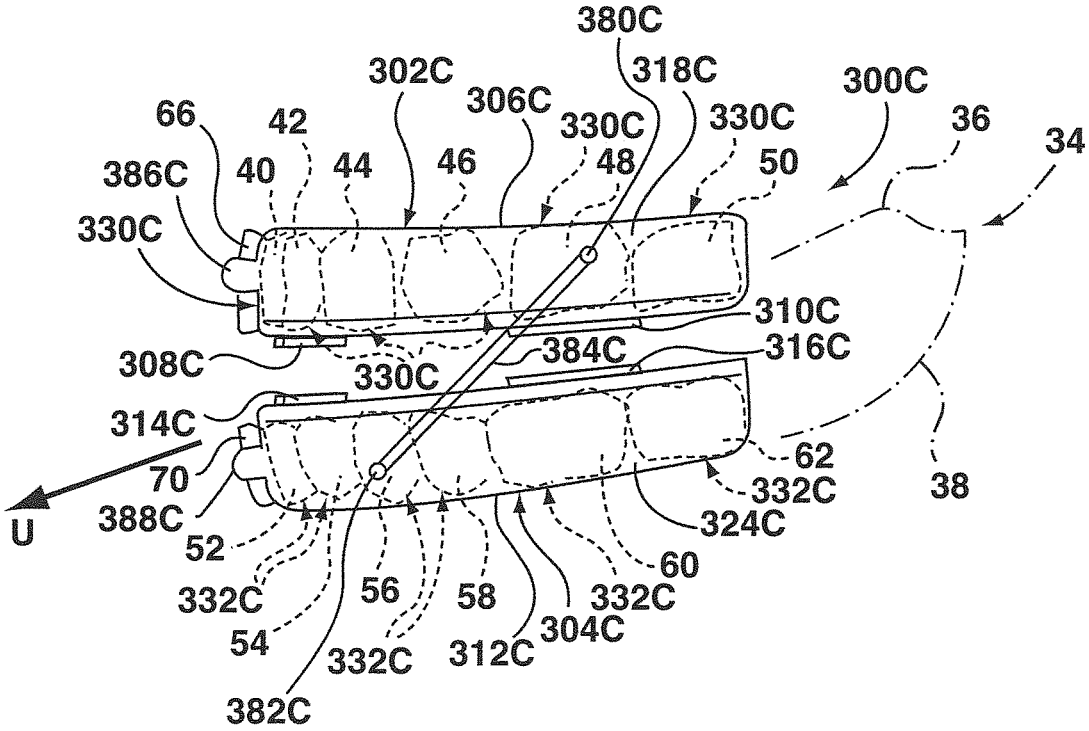
FIG. 3C is a side view showing a variant of the oral appliance system of FIG. 3A anchored to the teeth of a human jaw, with the jaw in a resting position.

A variant 300C of the third exemplary oral appliance system 300 is shown in FIG. 3C, with identical reference numerals used to refer to features of the third variant oral appliance system 300C which correspond to features of the third oral appliance system 300, but with the additional suffix "C". The variant oral appliance system 300C differs from the third oral appliance system 300 in that it includes, analogously to the variant 100C of the first embodiment 100, maxillary tether mountings 380C, mandibular tether mountings 382C and tethers 384C.

Figure 4A:
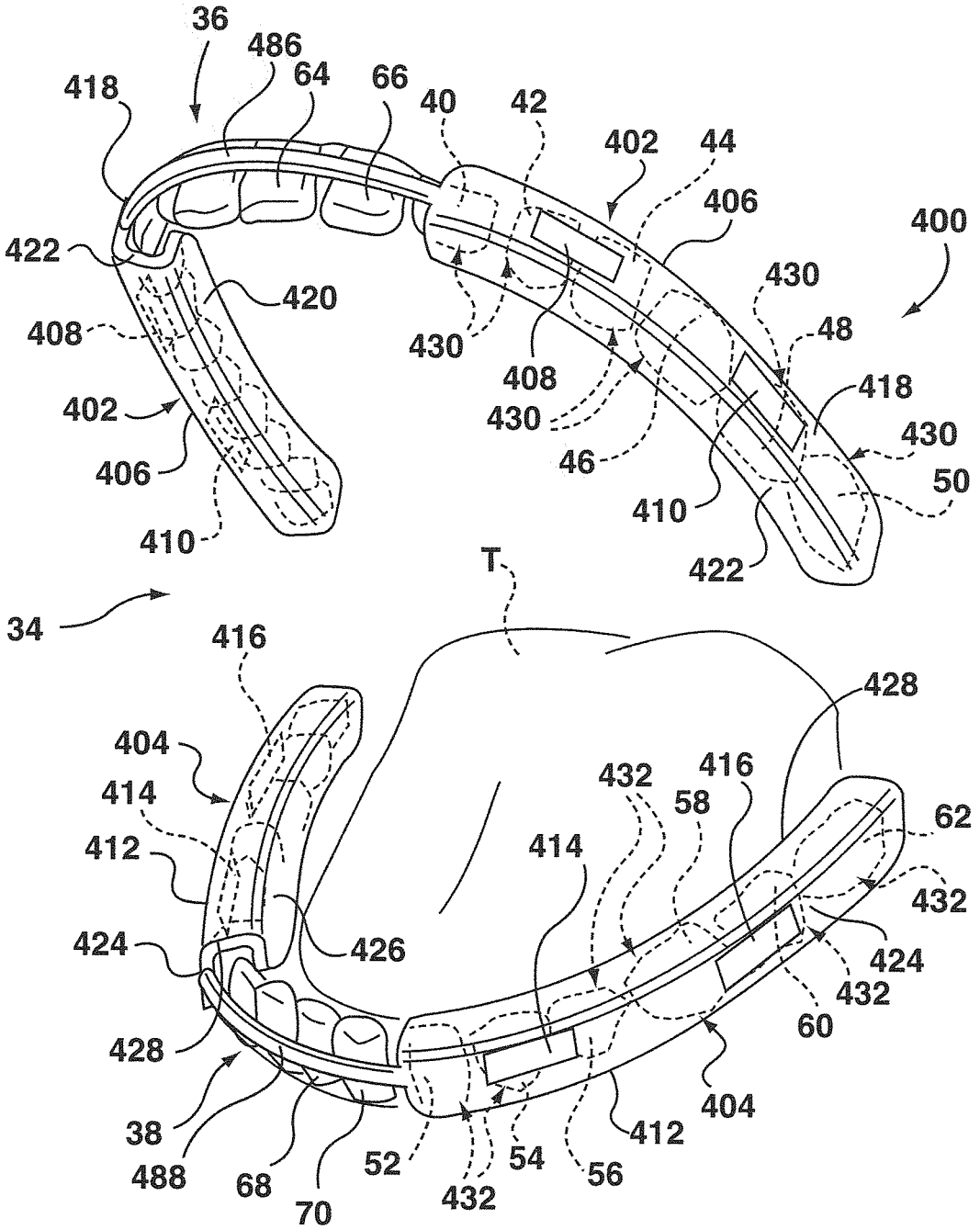
FIG. 4A is an upper front perspective view of a fourth exemplary oral appliance system anchored to the teeth of a human jaw, with the jaw in an exaggerated open position.
Figure 4B:
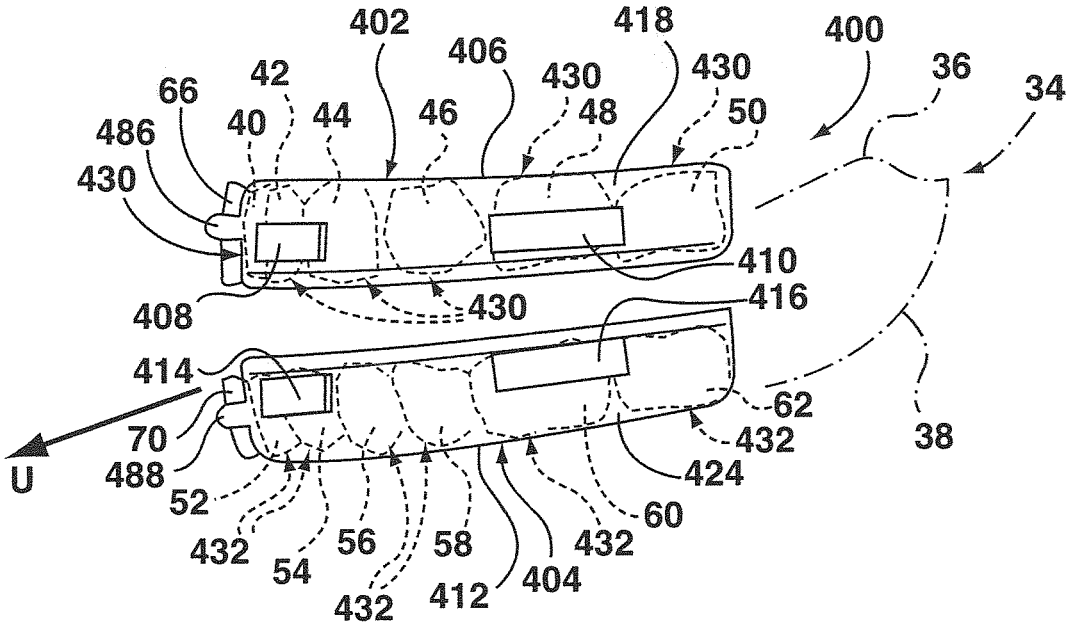
FIG. 4B is a side view of the oral appliance system of FIG. 4A anchored to the teeth of a human jaw, with the jaw in a resting position.

Reference is now made to FIGS. 4A and 4B, which show a fourth exemplary oral appliance system 400. In FIGS. 4A and 4B, the same reference numerals are used to refer to features corresponding to features in the third exemplary oral appliance system 300, except with the prefix "4" instead of "3". The fourth oral appliance system 400 is substantially identical to the third exemplary oral appliance system 300 shown in FIGS. 3A and 3B, except that, analogously to the second exemplary oral appliance system shown in FIGS. 2A and 2B, the anterior maxillary magnets 408 and posterior maxillary magnets 410 are set into the maxillary facial sidewalls 418 and the anterior mandibular magnets 414 and the posterior mandibular magnets 416 are set into the mandibular facial sidewalls 424.

Figure 4C:
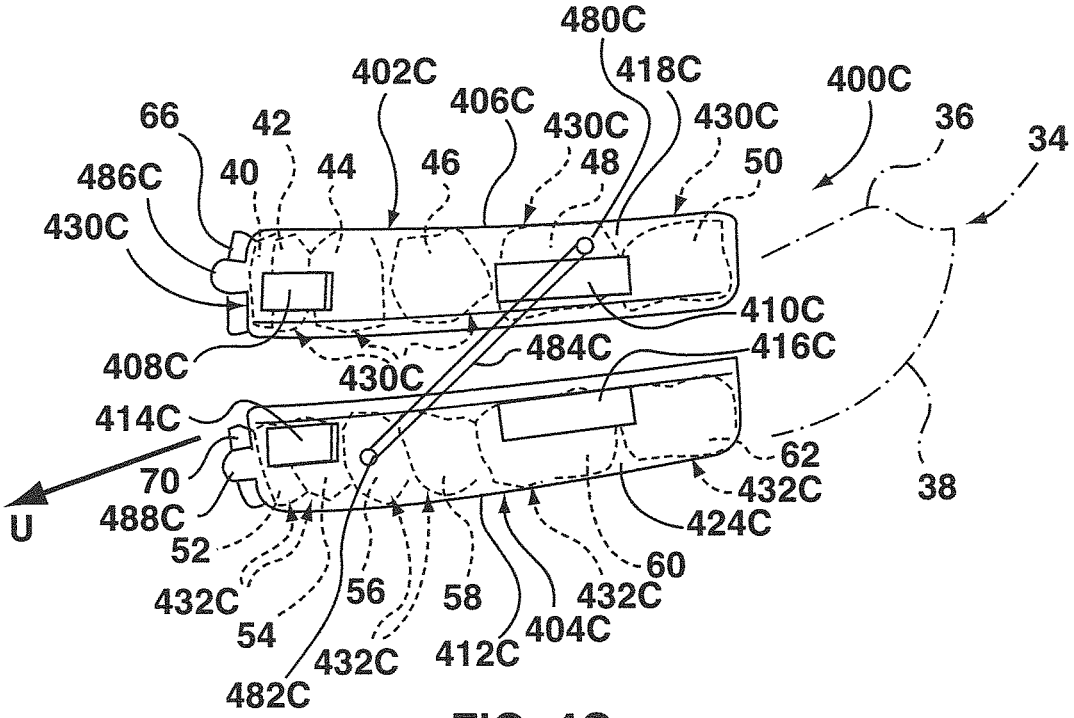
FIG. 4C is a side view showing a variant of the oral appliance system of FIG. 4A anchored to the teeth of a human jaw, with the jaw in a resting position.

FIG. 4C shows a variant 400C of the fourth oral appliance system 400, with corresponding reference numerals used to refer to corresponding features, only with the suffix "C". The variant oral appliance system 400C differs from the variant oral appliance 300C shown in FIG. 3C in the same way that the fourth oral appliance system 400 differs from the third oral appliance system 300, that is, in the positioning of the magnets 408C, 410C, 414C and 416C.

Figure 5A:
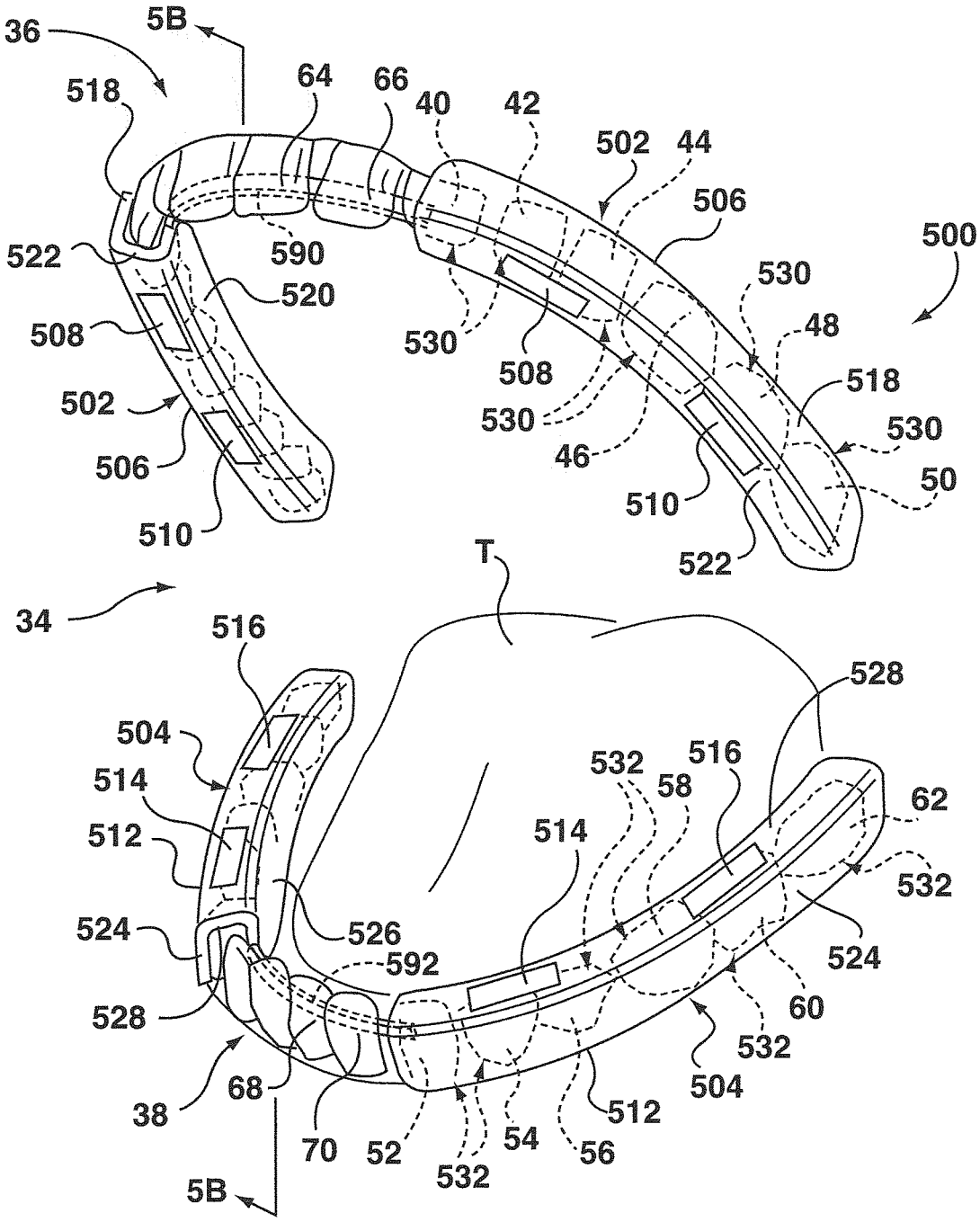
FIG. 5A is an upper front perspective view of a fifth exemplary oral appliance system anchored to the teeth of a human jaw, with the jaw in an exaggerated open position.
Figure 5B:
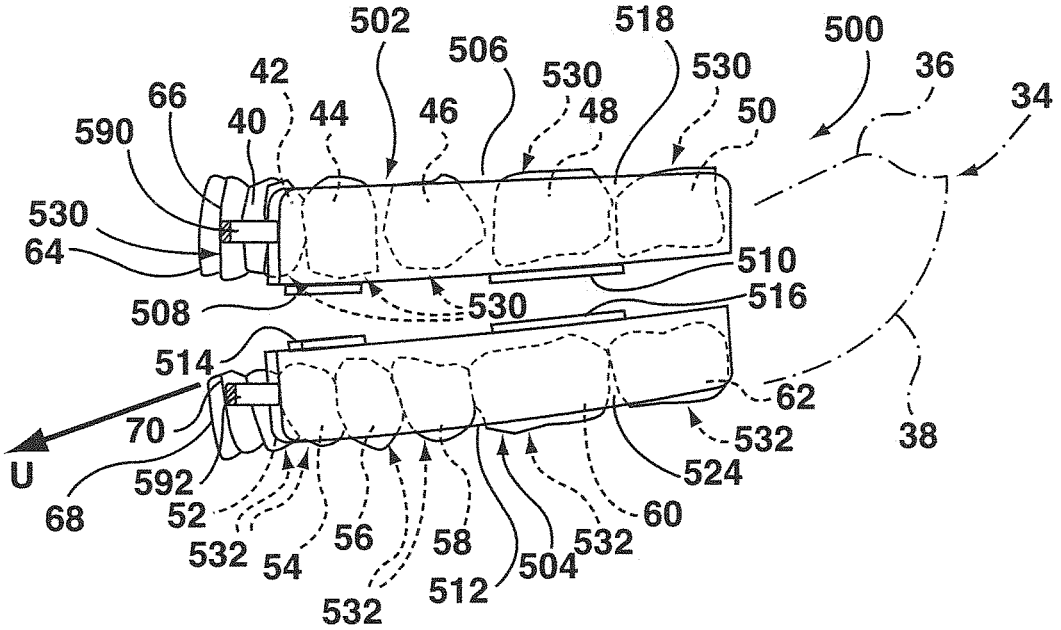
FIG. 5B is a side cross-sectional view of the oral appliance system of FIG. 5A, taken along the line 5B-5B in FIG. 5A, showing the oral appliance system anchored to the teeth of a human jaw, with the jaw in a resting position.

FIGS. 5A and 5B show a fifth exemplary oral appliance system 500 which is identical to the third exemplary oral appliance system 300 except that the opposed maxillary anchor portions 506 are connected to one another by a lingual-side maxillary anterior arch link 590 rather than a labial-side maxillary anterior arch link 386 and the opposed mandibular anchor portions 512 are connected to one another by a lingual-side mandibular anterior arch link 592 instead of a labial-side mandibular anterior arch link 388. Thus, like reference numerals are used to refer to like features, except with the prefix "5" instead of "3".

Figure 5C:
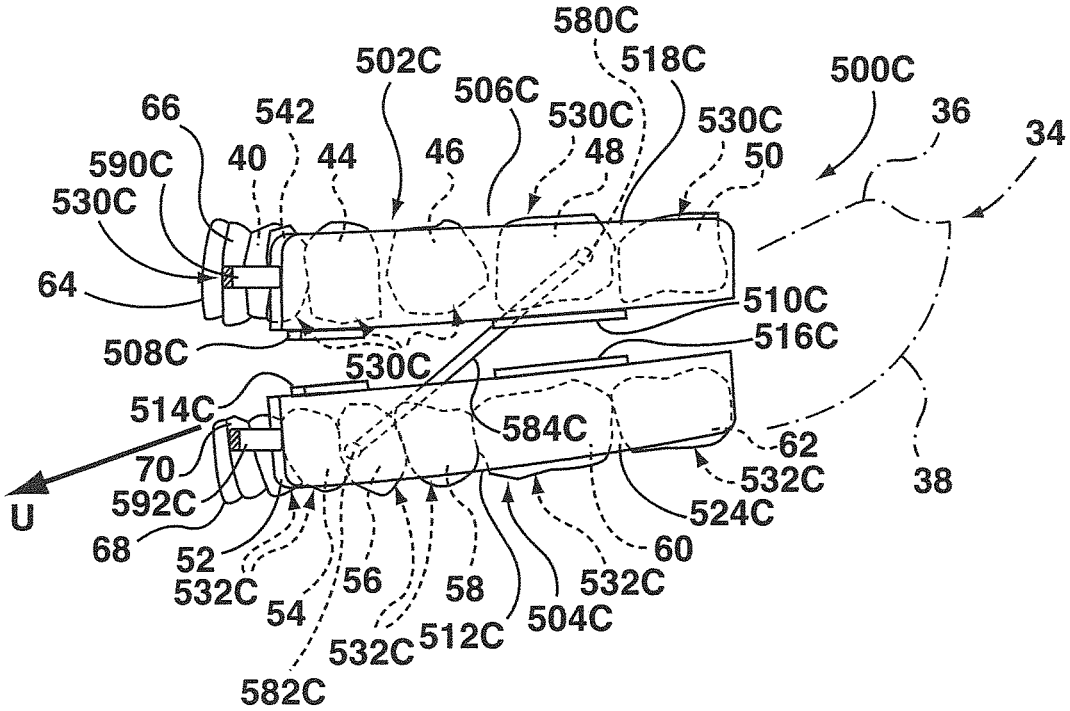
FIG. 5C is a side cross-sectional view showing a variant of the oral appliance system of FIG. 5A anchored to the teeth of a human jaw, with the jaw in a resting position.

FIG. 5C shows a variant 500C of the fifth exemplary oral appliance system 500 which includes maxillary tether mountings 580C, mandibular tether mountings 582C and tethers 584C, and the same reference numerals are used to refer to features of the variant oral appliance system 500C that correspond to features of the fifth exemplary oral appliance system 500, except with the suffix "C".

Figure 6A:
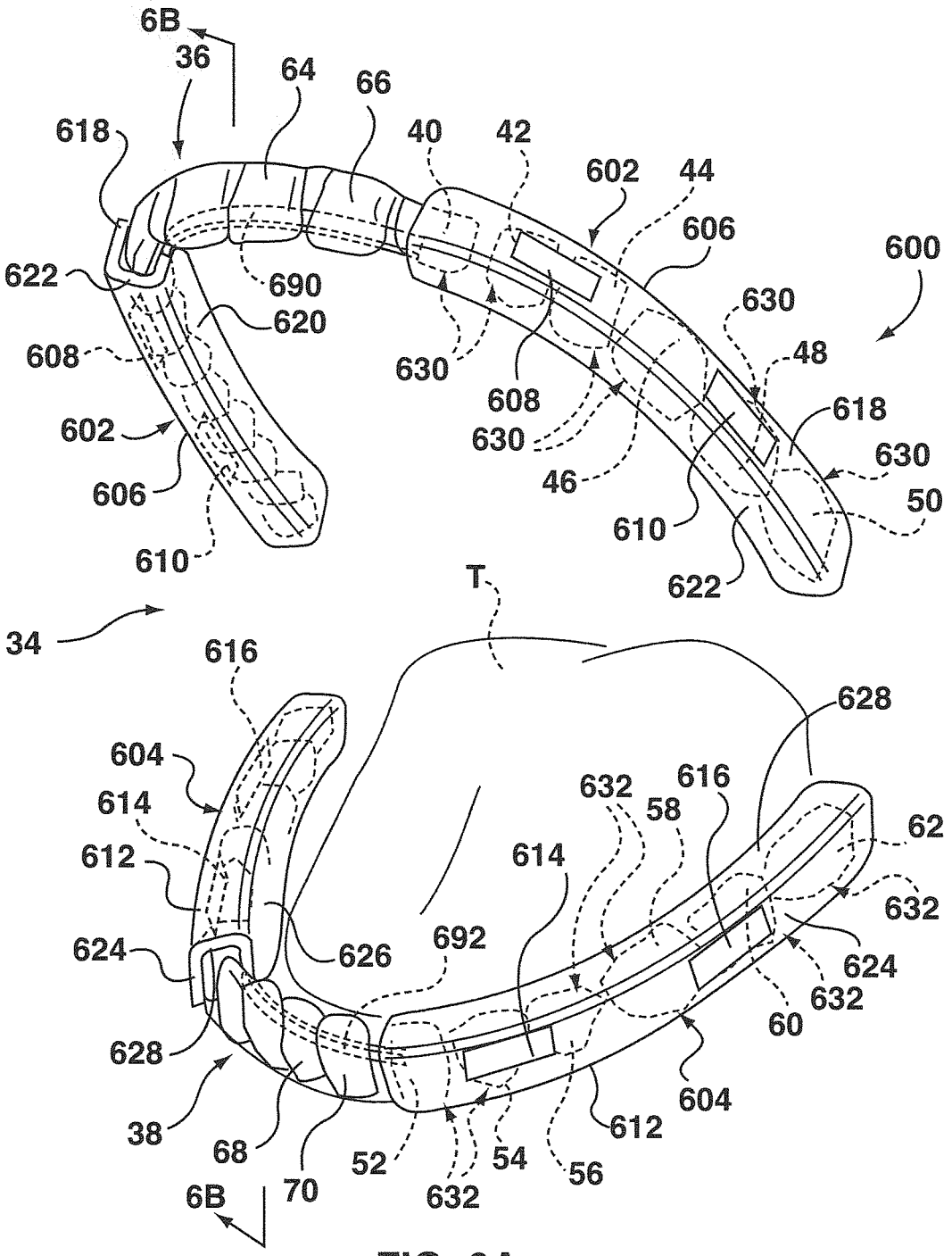
FIG. 6A is an upper front perspective view of a sixth exemplary oral appliance system anchored to the teeth of a human jaw, with the jaw in an exaggerated open position.
Figure 6B:
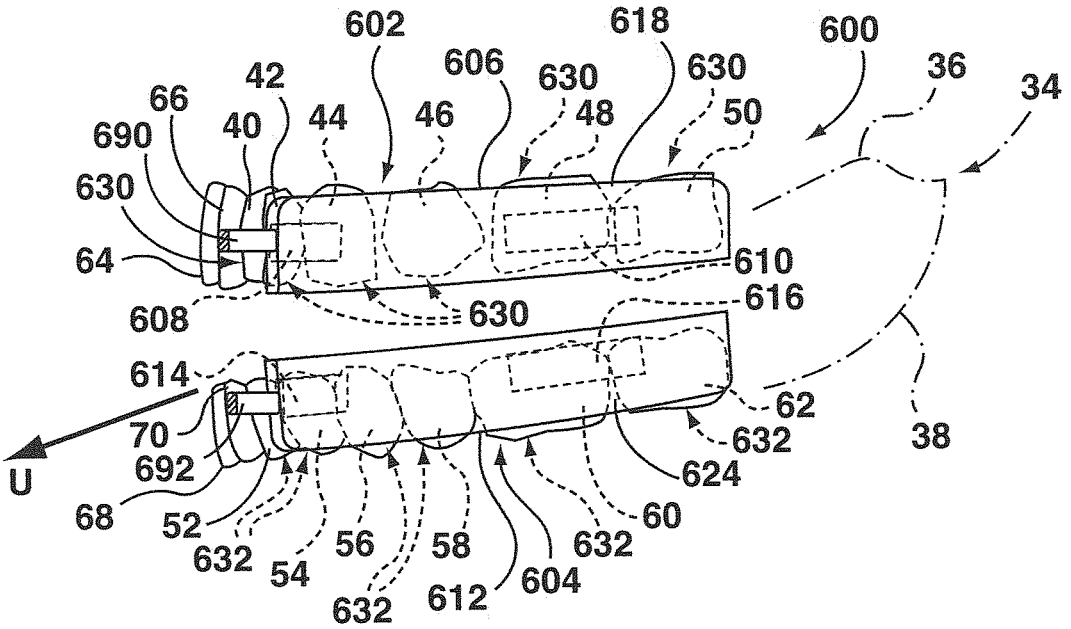
FIG. 6B is a side cross-sectional view of the oral appliance system of FIG. 6A, taken along the line 6B-6B in FIG. 6A, showing the oral appliance system anchored to the teeth of a human jaw, with the jaw in a resting position.

Reference is now made to FIGS. 6A and 6B, which show a sixth exemplary oral appliance system that is substantially identical to the fifth exemplary oral appliance system 500 shown in FIGS. 5A and 5B, except that, analogously to the second exemplary oral appliance system shown in FIGS. 2A and 2B, the anterior maxillary magnet 608 and posterior maxillary magnets 610 are set into the maxillary facial sidewalls 618 and the anterior mandibular magnets 614 and the posterior mandibular magnets 616 are set into the mandibular facial sidewalls 624. FIGS. 6A and 6B use the same reference numerals to refer to features corresponding to features in the fifth exemplary oral appliance system 500, except with the prefix "6" instead of "5".

Figure 6C:
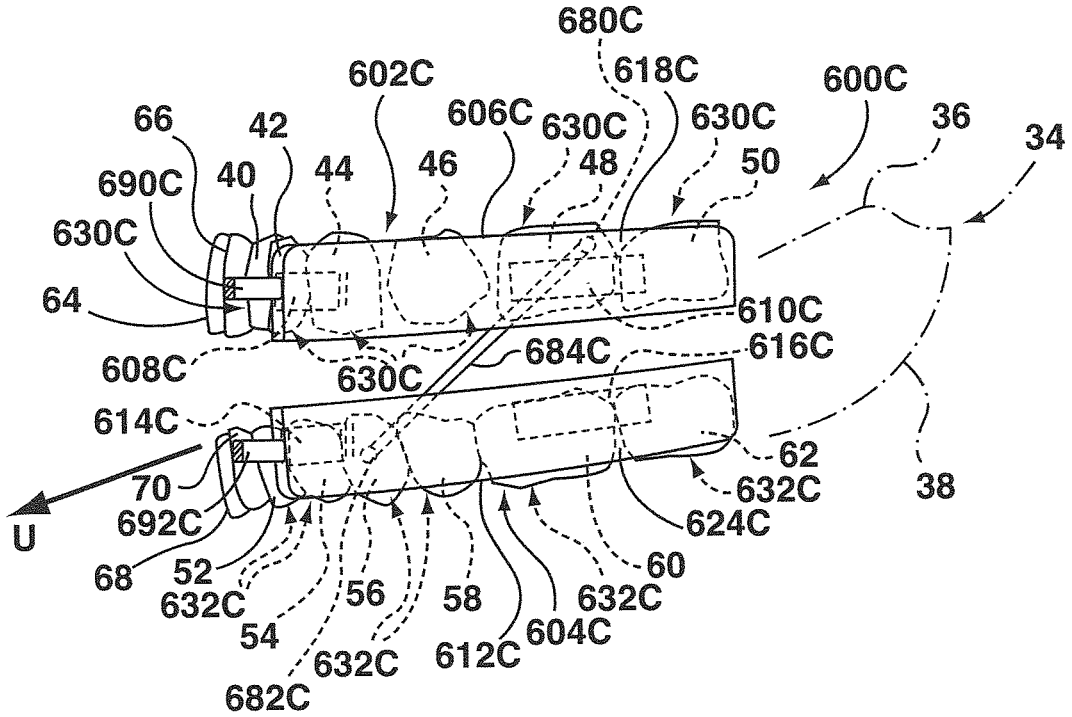
FIG. 6C is a side cross-sectional view showing a variant of the oral appliance system of FIG. 6A anchored to the teeth of a human jaw, with the jaw in a resting position.

A variant 600C of the sixth exemplary oral appliance system 600 is shown in FIG. 6C, with identical reference numerals used to refer to features of the variant oral appliance system 600C which correspond to features of the sixth oral appliance system 600, but with the additional suffix "C". The variant oral appliance system 600C differs from the sixth oral appliance system 600 in that it includes, analogously to the variant 100C of the first embodiment 100, maxillary tether mountings 680C, mandibular tether mountings 682C and tethers 684C.

Figure 7A:
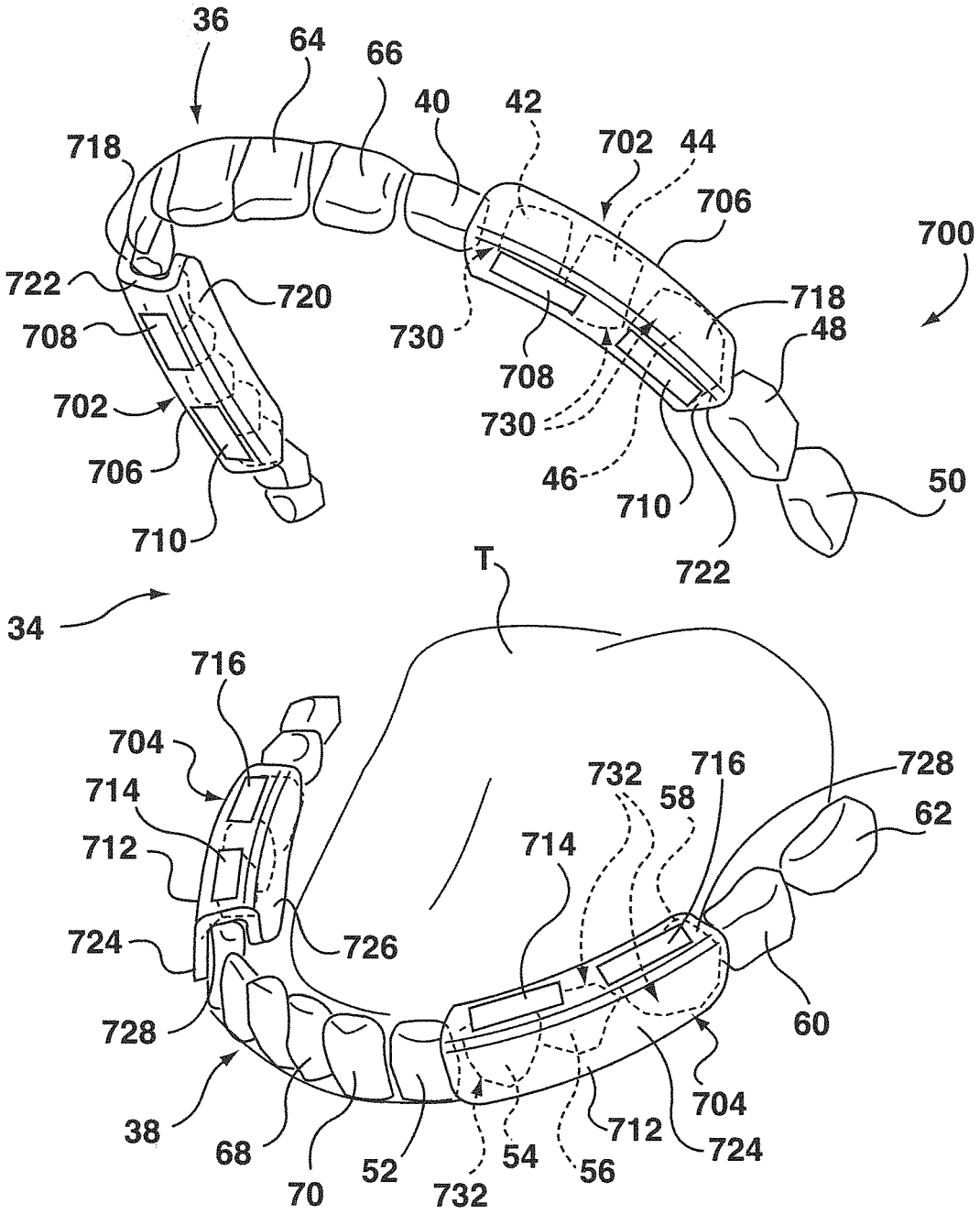
FIG. 7A is an upper front perspective view of a seventh exemplary oral appliance system anchored to the teeth of a human jaw, with the jaw in an exaggerated open position.
Figure 7B:
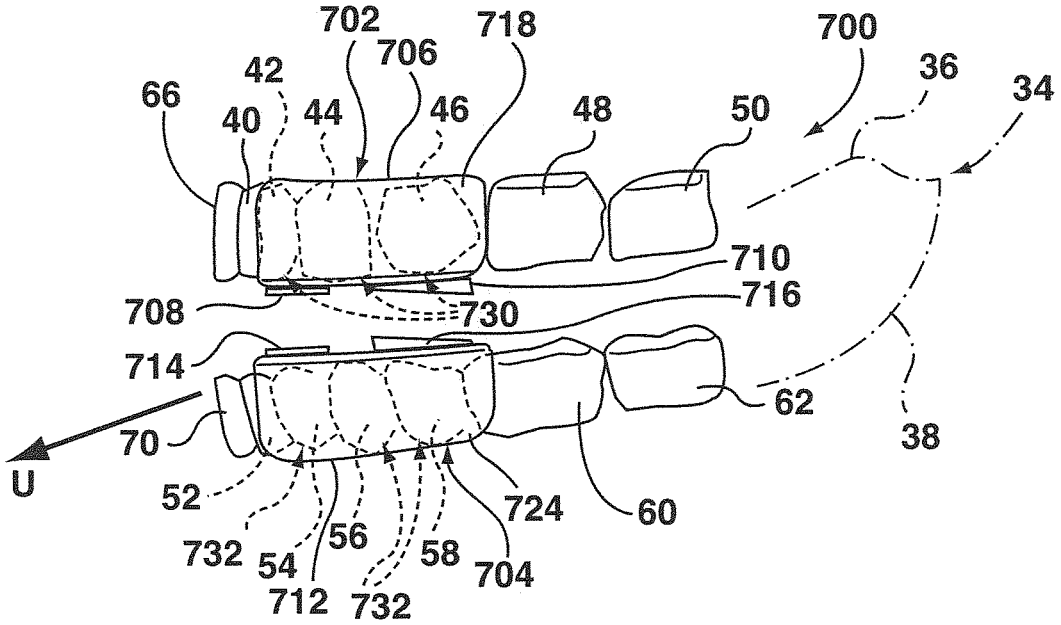
FIG. 7B is a side view of the oral appliance system of FIG. 7A anchored to the teeth of a human jaw, with the jaw in a resting position.

FIGS. 7A and 7B show a seventh exemplary oral appliance system 700 which is similar to the first exemplary oral appliance system 100 shown in FIGS. 1A and 1B, with corresponding reference numerals referring to corresponding features, except with the prefix "7" instead of "1". The seventh exemplary oral appliance system 700 shown in FIGS. 7A and 7B differs from the first exemplary oral appliance system 100 shown in FIGS. 1A and 1B in that each maxillary anchor portion 706 includes maxillary mounting receptacles 730 for securely removably receiving only a maxillary first premolar (PM1) tooth 42, a maxillary second premolar (PM2) tooth 44 and a maxillary first molar (M1) tooth 46, and the mandibular anchor portions 712 include mandibular mounting receptacles 732 for securely removably receiving only a mandibular first premolar (PM 1) tooth 54, a mandibular second premolar (PM2) tooth 56 and a mandibular first molar (M1) tooth 58. Because the maxillary appliances 702 and mandibular appliances 704 in the seventh embodiment are shorter than in the first embodiment, the anterior maxillary magnet 708 and posterior maxillary magnet 710 are closer to one another and the anterior mandibular magnet 714 and posterior mandibular magnet 716 are also closer to one another, as compared to the first exemplary oral appliance system 100 shown in FIGS. 1A and 1B. In addition, as best seen in FIG. 7B, the seventh exemplary oral appliance system 700 shown in FIGS. 7A and 7B further differs from the first exemplary oral appliance system 100 shown in FIGS. 1A and 1B in that the occlusal surfaces of the posterior maxillary magnet 710 and the posterior mandibular magnet 716 are angled relative to the occlusal plane, and are parallel to one another, to assist in urging the mandibular appliance 704 anteriorly relative to the maxillary appliance 702.

Figure 7C:
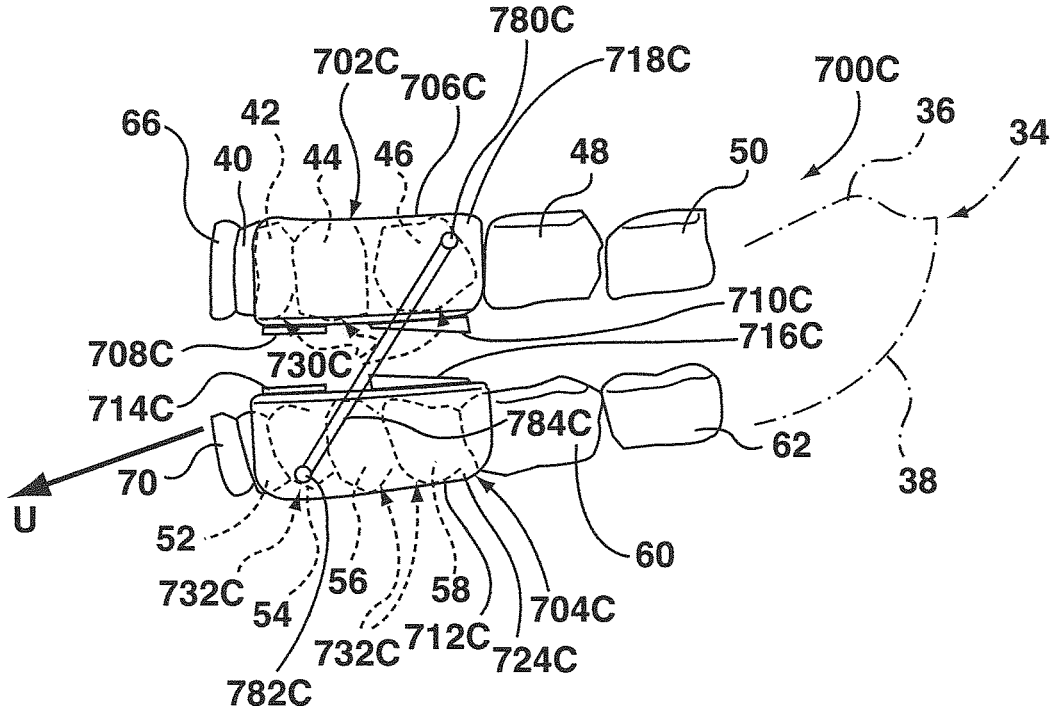
FIG. 7C is a side view showing a variant of the oral appliance system of FIG. 7A anchored to the teeth of a human jaw, with the jaw in a resting position.

FIG. 7C shows a variant 700C of the seventh exemplary oral appliance system 700 which includes maxillary tether mountings 780C, mandibular tether mountings 782C and tethers 784C, analogously to the variant 100C of the first embodiment 100. The same reference numerals are used to refer to features of the variant oral appliance system 700C that correspond to features of the seventh exemplary oral appliance system 700, except with the suffix "C".

Figure 8A:
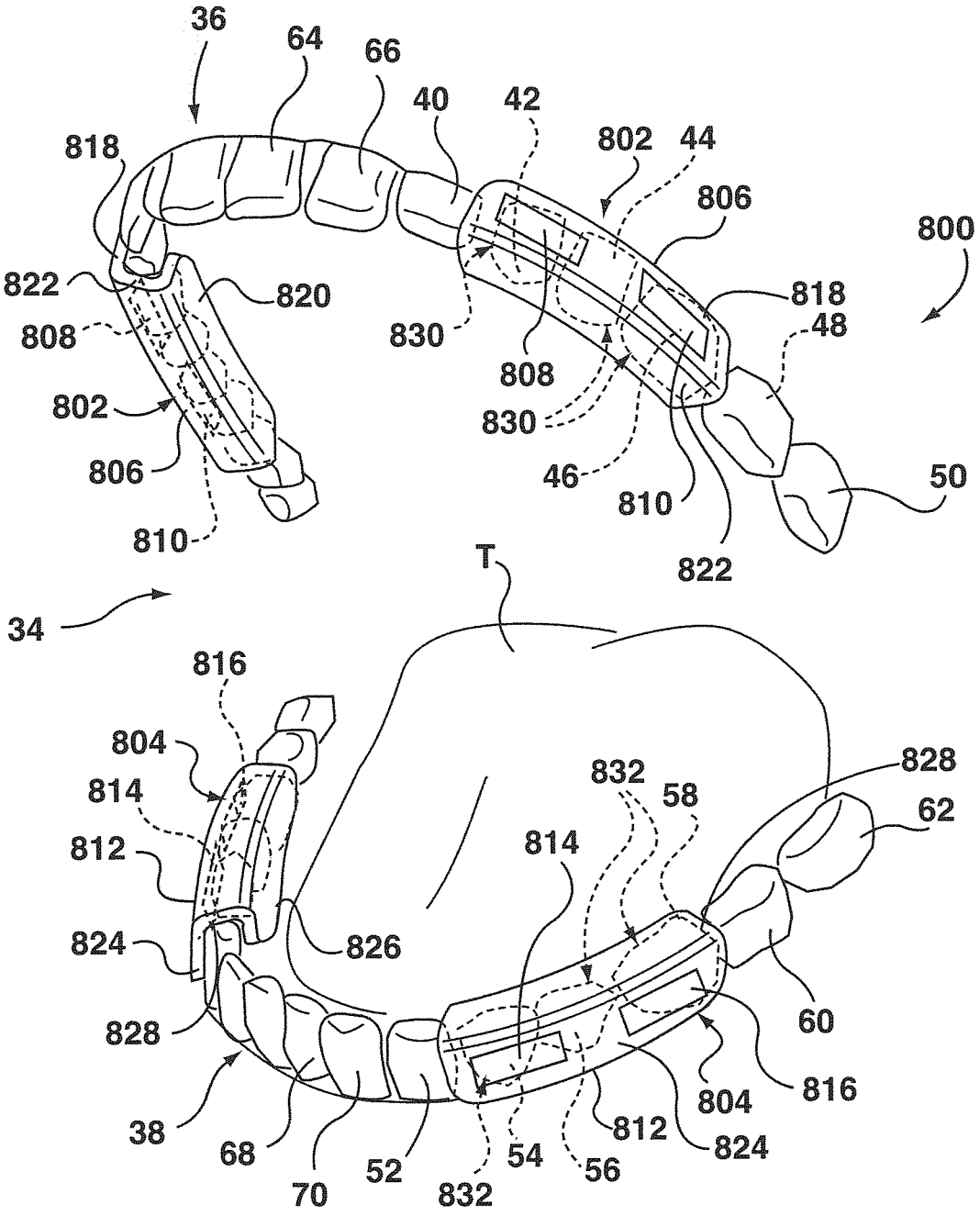
FIG. 8A is an upper front perspective view of an eighth exemplary oral appliance system anchored to the teeth of a human jaw, with the jaw in an exaggerated open position.
Figure 8B:
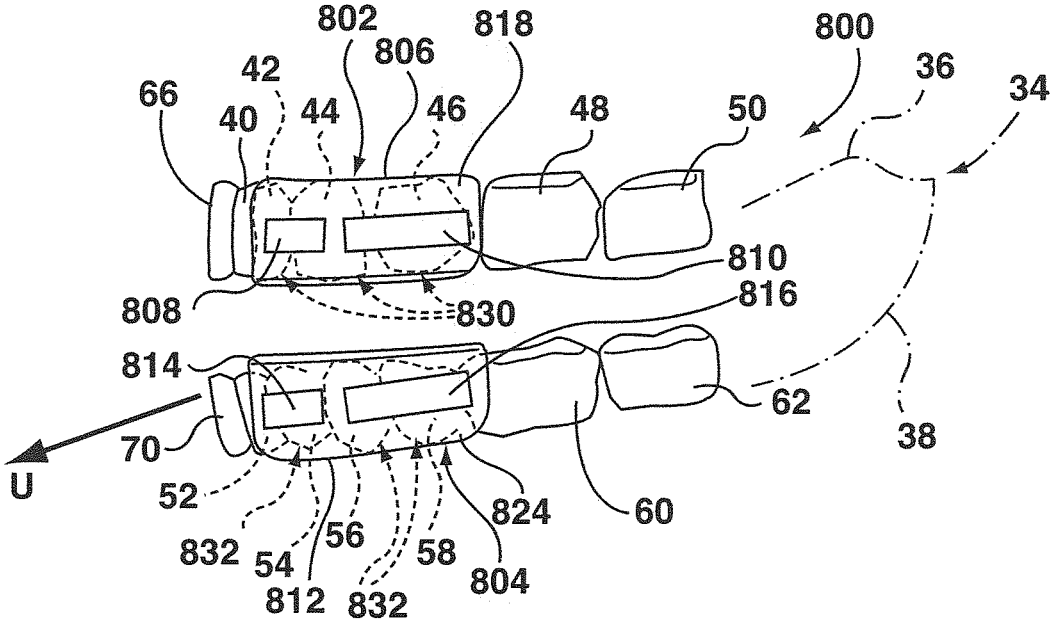
FIG. 8B is a side view of the oral appliance system of FIG. 8A anchored to the teeth of a human jaw, with the jaw in a resting position.

Referring now to FIGS. 8A and 8B, an eighth exemplary oral appliance system is denoted generally by reference 800. The eighth exemplary oral appliance system 800 shown in FIGS. 8A and 8B is substantially identical to the seventh exemplary oral appliance system 700 shown in FIGS. 7A and 7B, except that in the eighth exemplary oral appliance system 800, the anterior maxillary magnet 808 and posterior maxillary magnet 810 of each maxillary appliance 802 are set into the maxillary facial sidewall 818 and the anterior mandibular magnet 814 and the posterior mandibular magnet 816 of each mandibular appliance 804 are set into the mandibular facial sidewall 824. Hence, corresponding reference numerals are used to refer to corresponding features, except with the prefix "8" instead of "7".

Figure 8C:
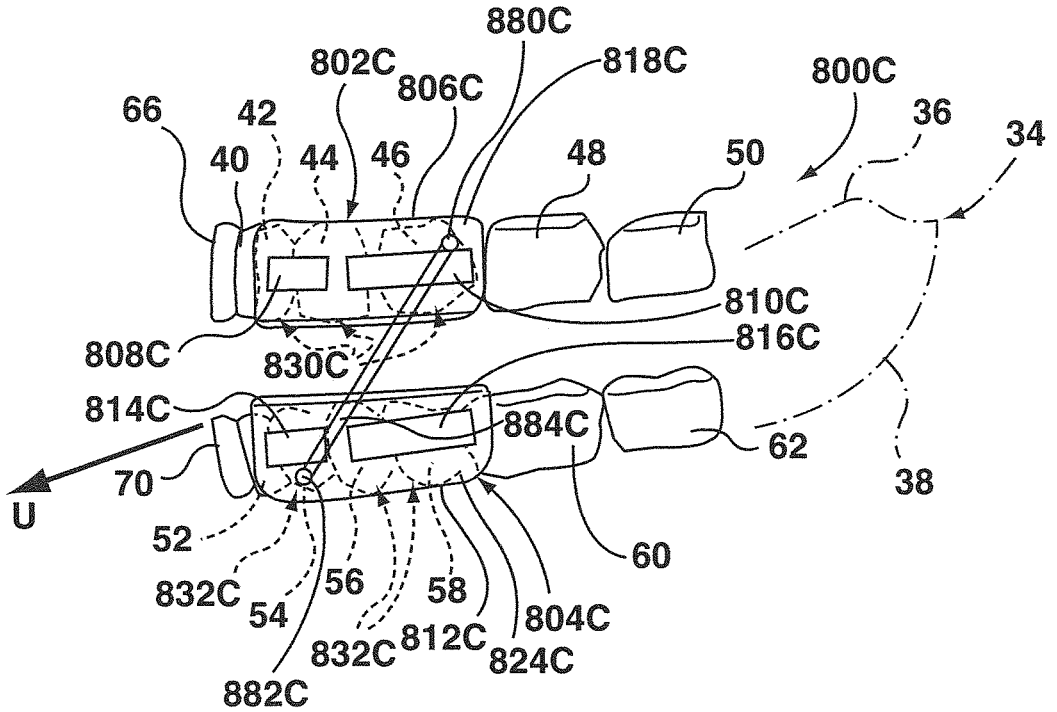
FIG. 8C is a side view showing a variant of the oral appliance system of FIG. 8A anchored to the teeth of a human jaw, with the jaw in a resting position.

A variant 800C of the eighth exemplary oral appliance system 800 is shown in FIG. 8C. The variant oral appliance system 800C includes maxillary tether mountings 880C, mandibular tether mountings 882C and tethers 884C, and the same reference numerals are used to refer to features of the variant oral appliance system 800C that correspond to features of the eighth exemplary oral appliance system 800, except with the suffix "C".

Figure 9A:
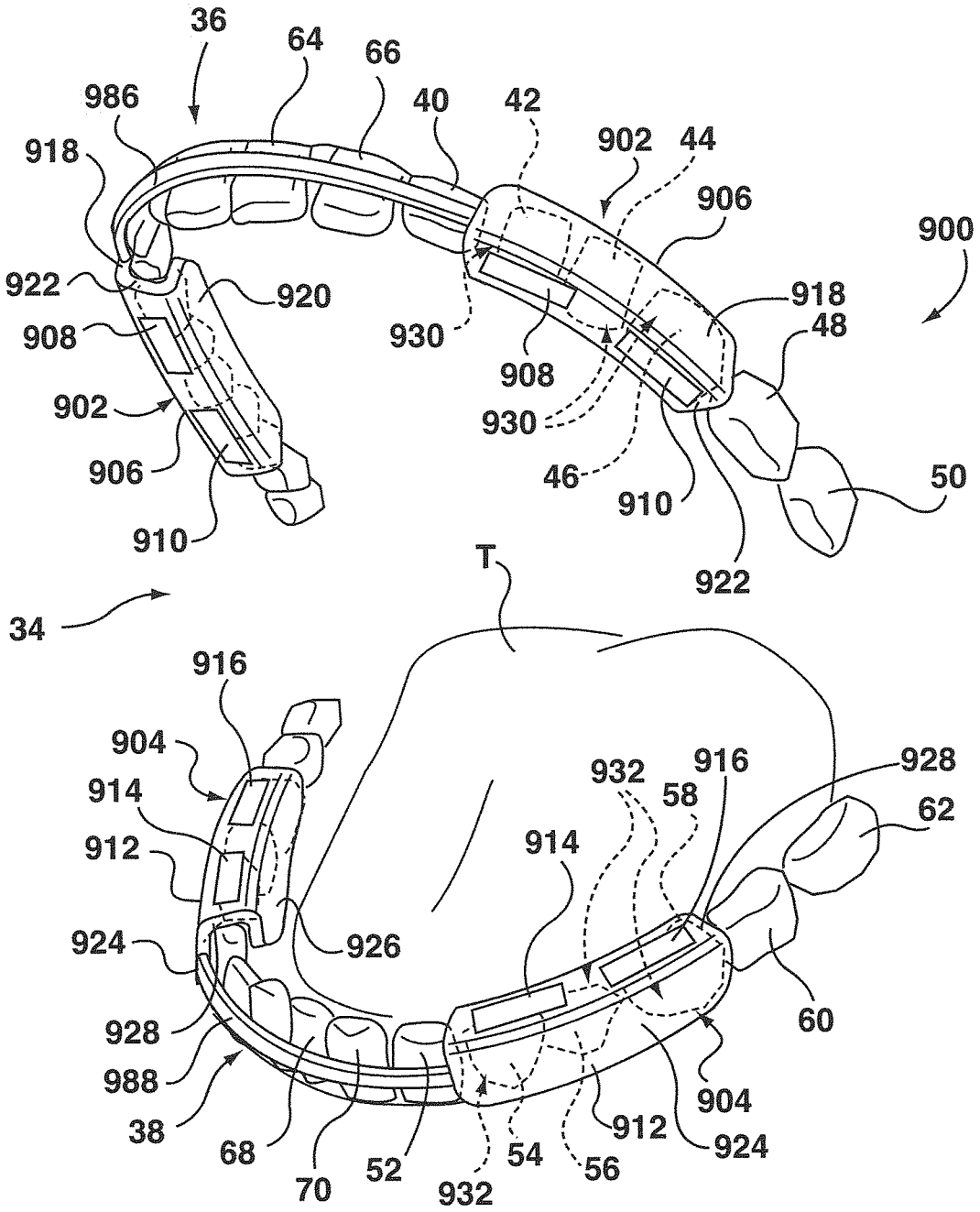
FIG. 9A is an upper front perspective view of a ninth exemplary oral appliance system anchored to the teeth of a human jaw, with the jaw in an exaggerated open position.
Figure 9B:
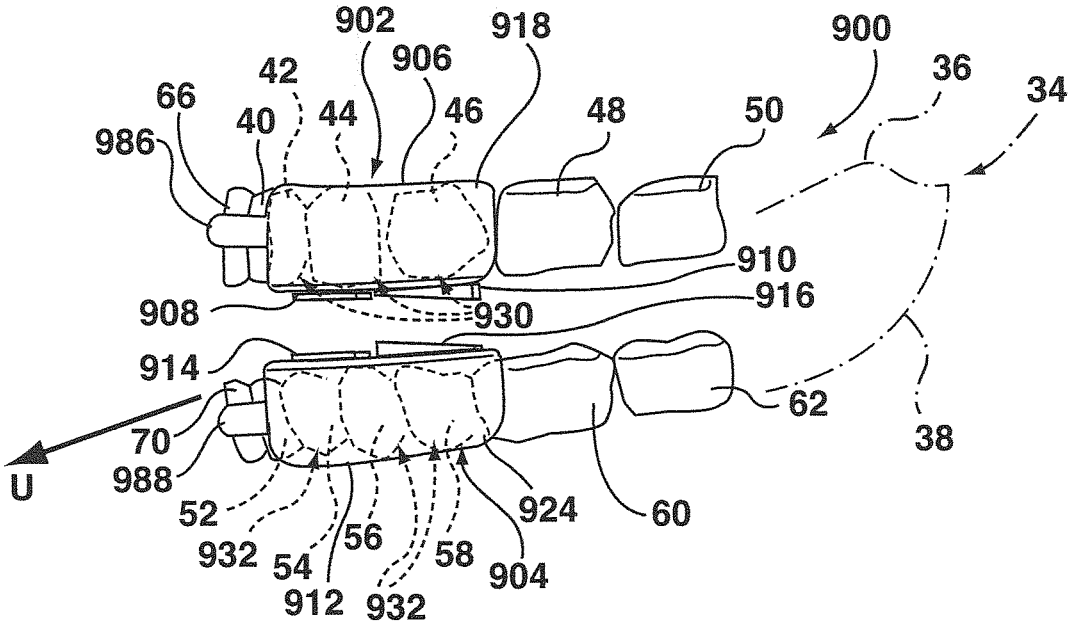
FIG. 9B is a side view of the oral appliance system of FIG. 9A anchored to the teeth of a human jaw, with the jaw in a resting position.

FIGS. 9A and 9B show a ninth exemplary oral appliance system 900. The ninth exemplary oral appliance system 900 is very similar to the seventh exemplary oral appliance system 700, with corresponding reference numerals used to denote corresponding features, except with the prefix "9" instead of "7". The ninth exemplary oral appliance system 900 differs from the seventh exemplary oral appliance system 700 in that it comprises only a single maxillary appliance 902 and only a single mandibular appliance 904. The single maxillary appliance 902 comprises a pair of opposed maxillary anchor portions 906 very similar to the maxillary anchor portions 706 shown in FIG. 7, but which are connected to one another by a labial-side maxillary anterior arch link 986. Similarly, the single mandibular appliance 904 comprises a pair of opposed mandibular anchor portions 912, very similar to the mandibular anchor portions 712 shown in FIG. 7, but which are connected to one another by a labial-side mandibular anterior arch link 988. When the ninth exemplary oral appliance system 900 is mounted on a user's teeth, the labial-side maxillary anterior arch link 986 extends across the maxillary central incisor teeth 64, the maxillary lateral incisor teeth 66 and the maxillary second premolar (PM2) tooth 40 on the labial sides thereof, and the labial-side mandibular anterior arch link 988 extends across the labial sides of the mandibular central incisor teeth 68, the mandibular lateral incisor teeth 70 and the mandibular first premolar (PM1) tooth 52.

Figure 9C:
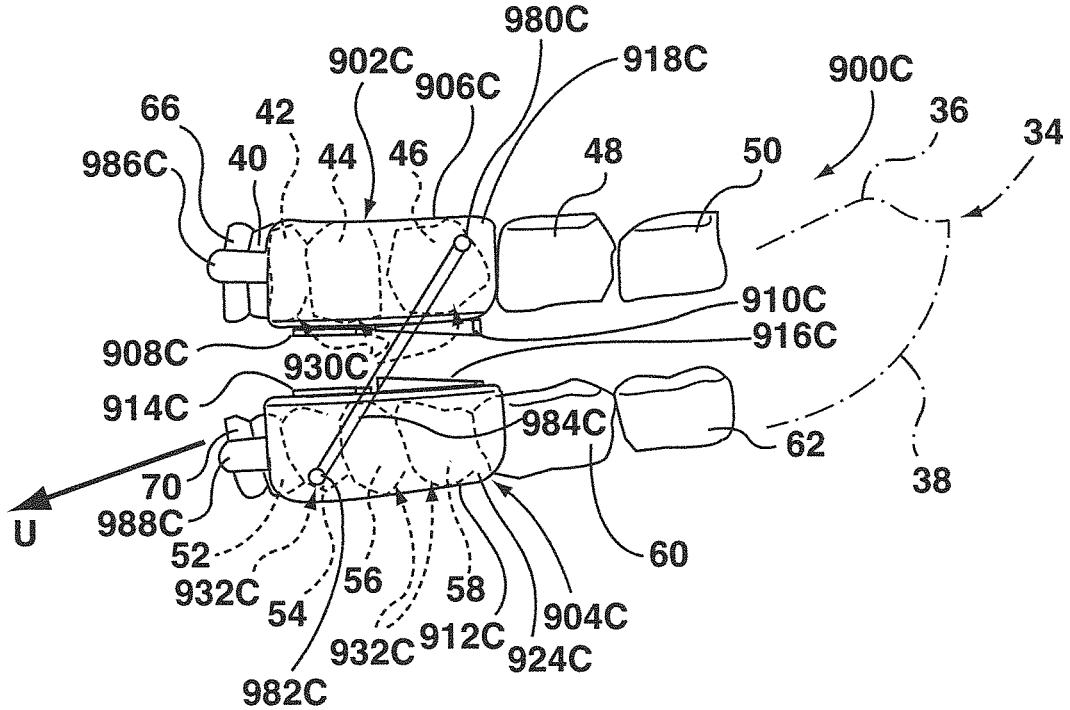
FIG. 9C is a side view showing a variant of the oral appliance system of FIG. 9A anchored to the teeth of a human jaw, with the jaw in a resting position.

FIG. 9C shows a variant 900C of the ninth exemplary oral appliance system 900, with identical reference numerals used to refer to features of the variant oral appliance system 900C which correspond to features of the ninth oral appliance system 900, but with the additional suffix "C". The variant oral appliance system 900C differs from the ninth oral appliance system 900 in that it includes, analogously to the variant 700C of the seventh embodiment 700, maxillary tether mountings 980C, mandibular tether mountings 982C and tethers 984C.

Figure 10A:
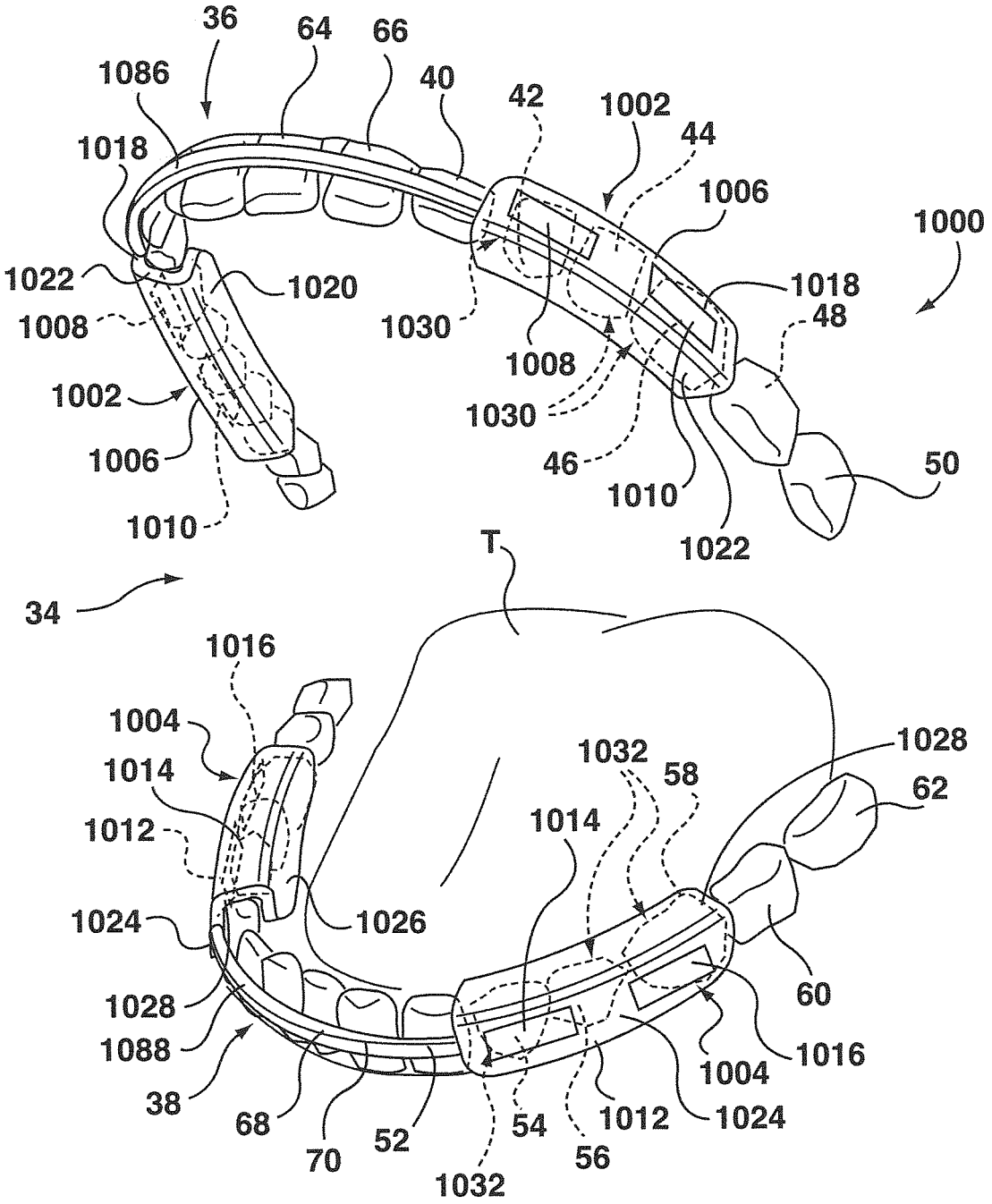
FIG. 10A is an upper front perspective view of a tenth exemplary oral appliance system anchored to the teeth of a human jaw, with the jaw in an exaggerated open position.
Figure 10B:
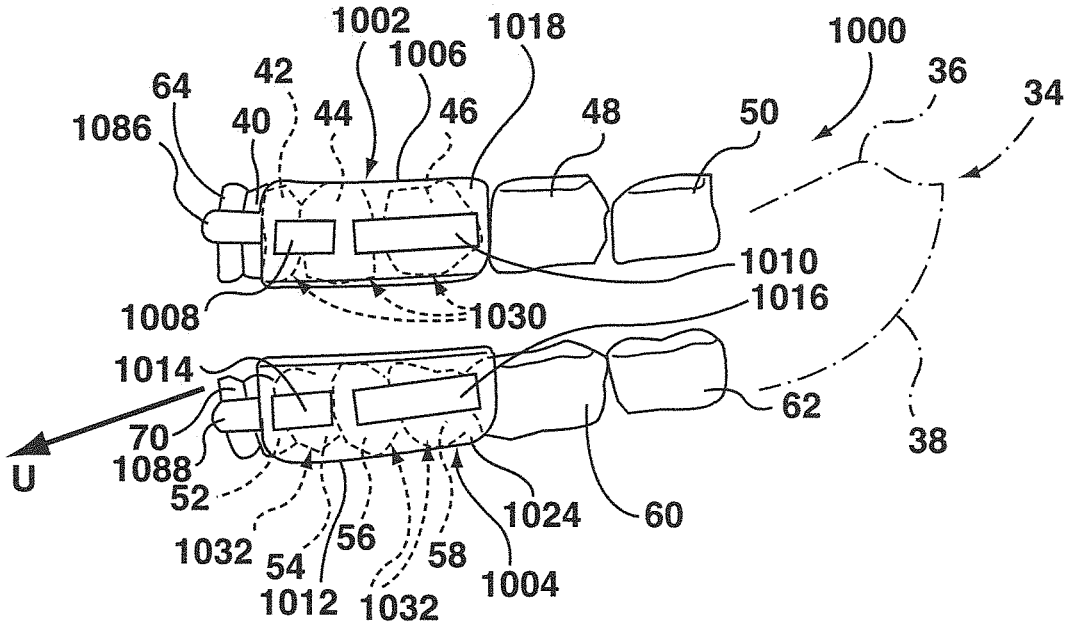
FIG. 10B is a side view of the oral appliance system of FIG. 10A anchored to the teeth of a human jaw, with the jaw in a resting position.

Reference is now made to FIGS. 10A and 10B, which show a tenth exemplary oral appliance system 1000. In FIGS. 10A and 10B, the same reference numerals are used to refer to features corresponding to features in the ninth exemplary oral appliance system 900, except with the prefix "10" instead of "9". The tenth oral appliance system 1000 is substantially identical to the ninth exemplary oral appliance system 900 shown in FIGS. 9A and 9B, except that the anterior maxillary magnets 1008 and posterior maxillary magnets 1010 are set into the maxillary facial sidewalls 1018 and the anterior mandibular magnets 1014 and the posterior mandibular magnets 1016 are set into the mandibular facial sidewalls 1024.

Figure 10C:
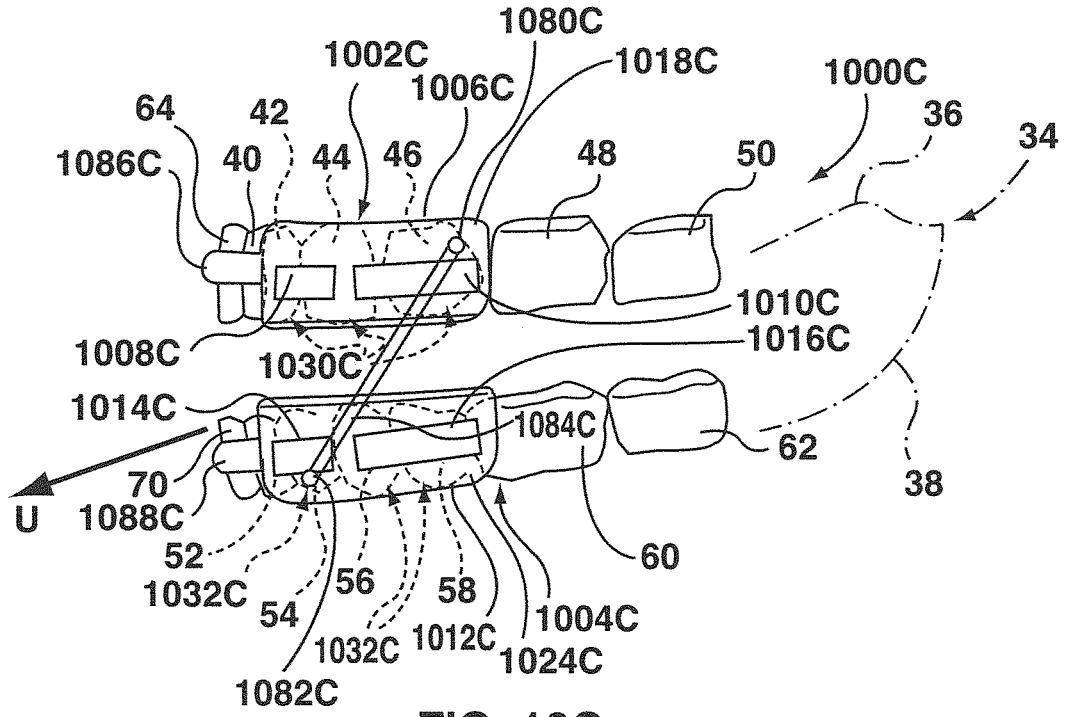
FIG. 10C is a side view showing a variant of the oral appliance system of FIG. 10A anchored to the teeth of a human jaw, with the jaw in a resting position.

FIG. 10C shows a variant 1000C of the tenth oral appliance system 1000, with corresponding reference numerals used to refer to corresponding features, only with the suffix "C". The variant oral appliance system 1000C differs from the variant oral appliance 900C shown in FIG. 9C in the same way that the tenth oral appliance system 1000 differs from the ninth oral appliance system 900, that is, in the positioning of the magnets 1008, 1010, 1014 and 1016.

Figure 11A:
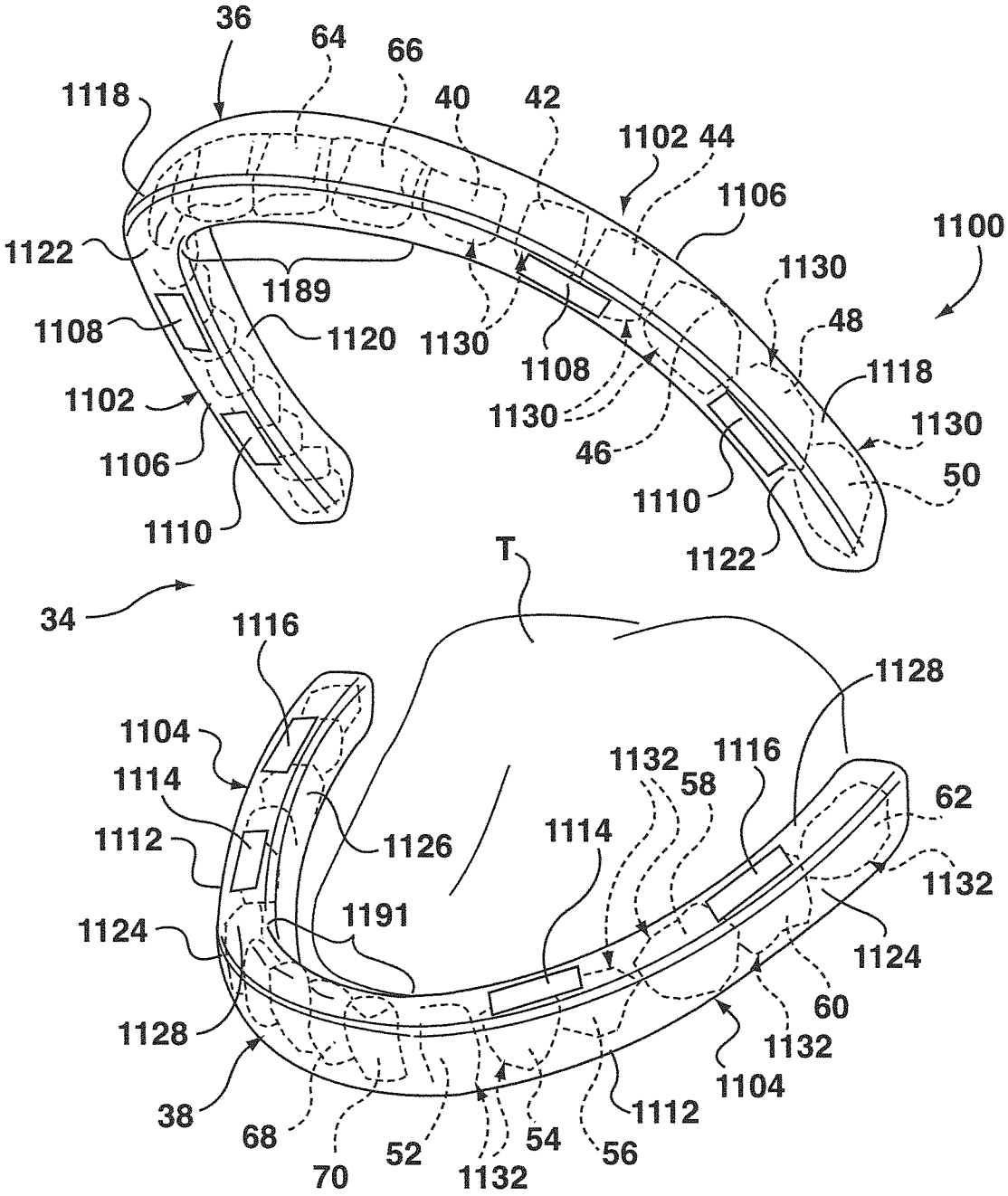
FIG. 11A is an upper front perspective view of an eleventh exemplary oral appliance system anchored to the teeth of a human jaw, with the jaw in an exaggerated open position.
Figure 11B:
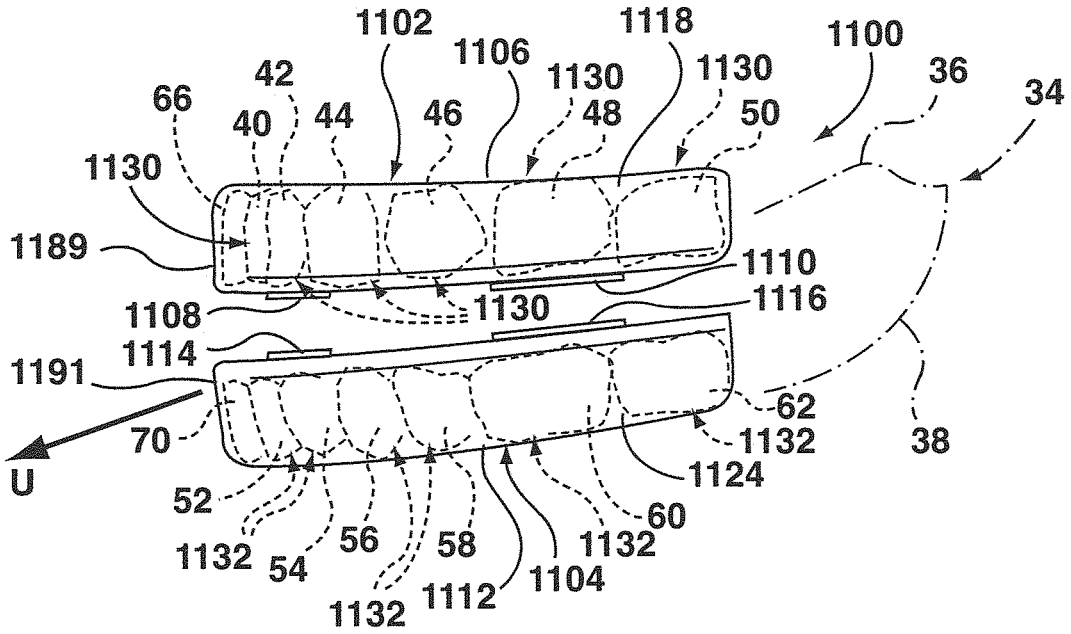
FIG. 11B is a side view of the oral appliance system of FIG. 11A anchored to the teeth of a human jaw, with the jaw in a resting position.

FIGS. 11A and 11B show an eleventh exemplary oral appliance system 1100. The eleventh exemplary oral appliance system 1100 is similar to the third exemplary oral appliance system 300 shown in FIGS. 3A and 3B, with like reference numerals referring to corresponding features except with the prefix "11" instead of "3". The eleventh exemplary oral appliance system 1100 differs from the third exemplary oral appliance system 300 in that the maxillary anterior arch link 1189 joining the opposed maxillary anchor portions 1106 and the mandibular anterior arch link 1191 joining the mandibular anchor portions 1112 are each channel-shaped for receiving incisors therewithin. Thus, the maxillary central and lateral incisors 64, 66 are received in the channel formed by the maxillary anterior arch link 1189 and the mandibular central and lateral incisors 68, 70 are received in the channel formed by the mandibular anterior arch link 1191. In the particular exemplary embodiment shown in FIGS. 11A and 11B, the maxillary anterior arch link 1189 and the mandibular anterior arch link 1191 define individual mounting receptacles for the incisors, similar to the maxillary mounting receptacles 1130 and mandibular mounting receptacles 1132, so that the maxillary anterior arch link 1189 and the mandibular anterior arch link 1191 may provide additional anchoring. In other embodiments, the maxillary anterior arch link and the mandibular anterior arch link may be a simple channel in which the incisors are received, without any individual mounting receptacles.

Figure 11C:
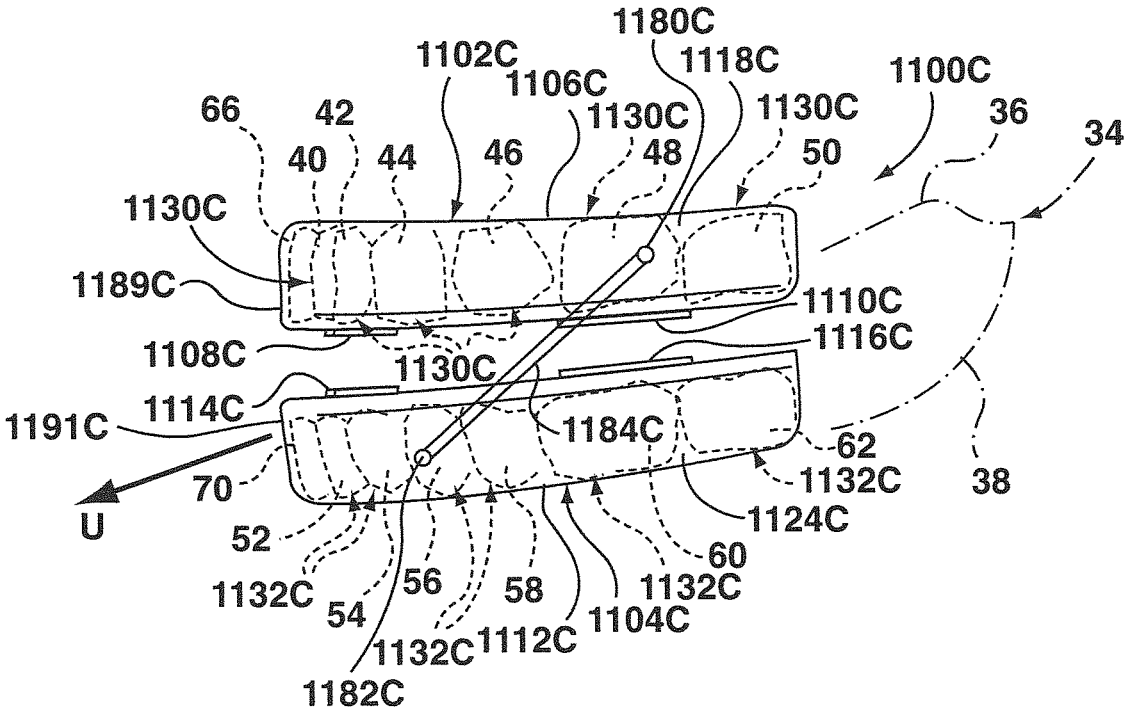
FIG. 11C is a side view showing a variant of the oral appliance system of FIG. 11A anchored to the teeth of a human jaw, with the jaw in a resting position.

A variant 1100C of the eleventh exemplary oral appliance system 1100 is shown in FIG. 11C, with identical reference numerals used to refer to features of the variant oral appliance system 1100C which correspond to features of the eleventh oral appliance system 1100, but with the additional suffix "C". The variant oral appliance system 1100C differs from the eleventh oral appliance system 1100 in that it includes, analogously to the variant 100C of the first embodiment 100, maxillary tether mountings 1180C, mandibular tether mountings 1182C and tethers 1184C.

Figure 12A:
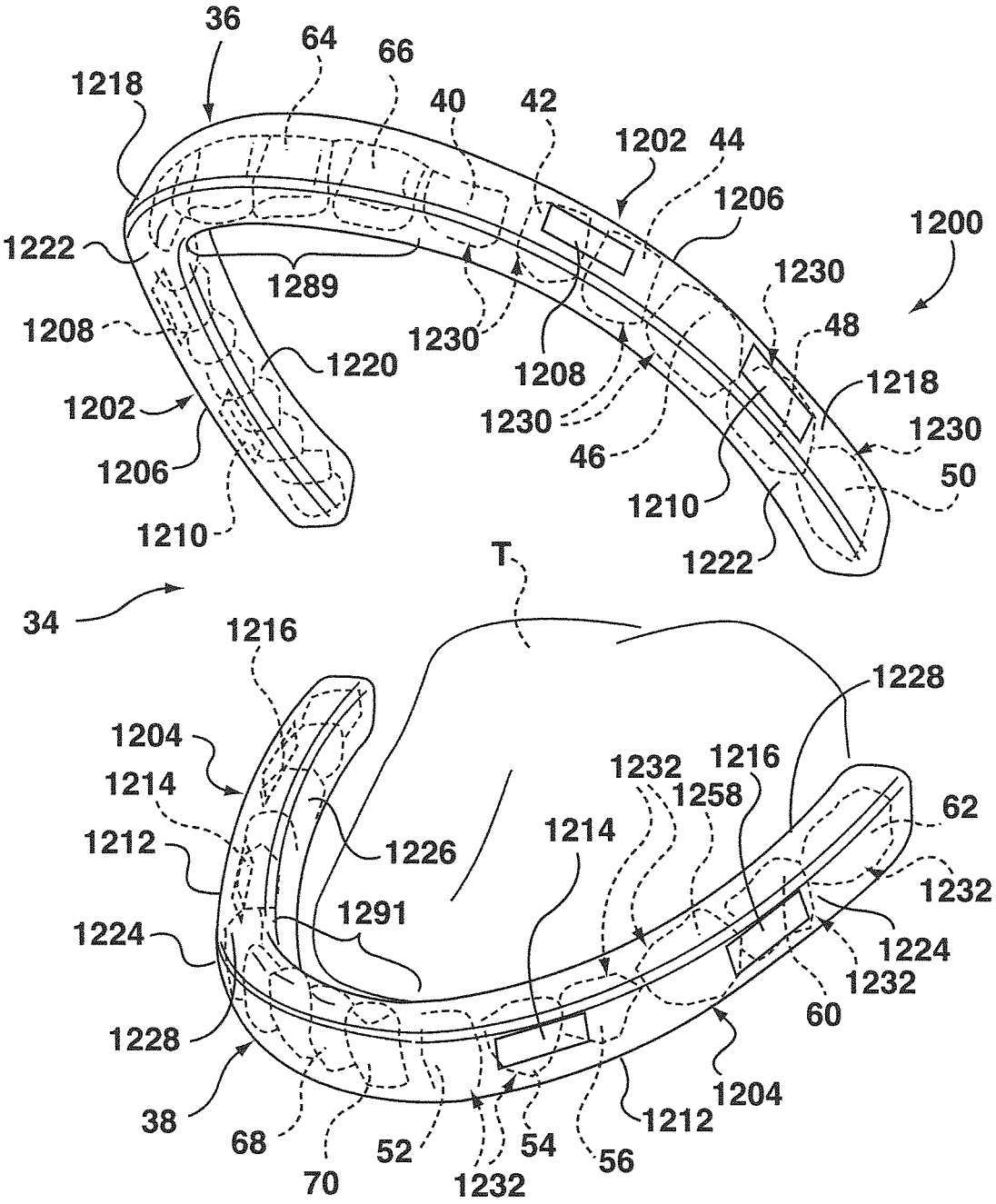
FIG. 12A is an upper front perspective view of a twelfth exemplary oral appliance system anchored to the teeth of a human jaw, with the jaw in an exaggerated open position.
Figure 12B:
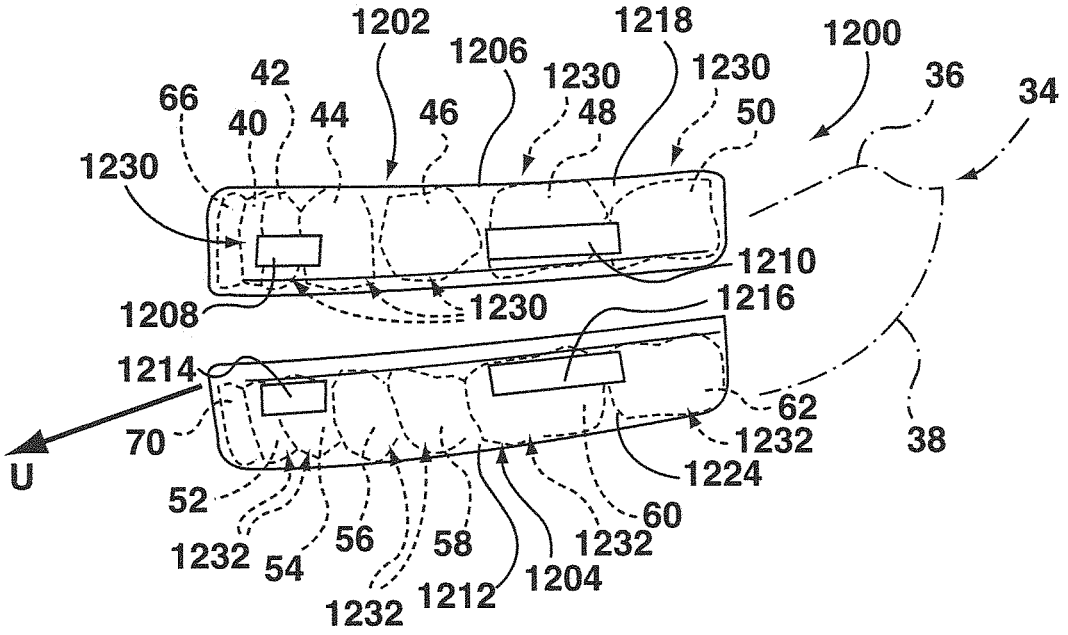
FIG. 12B is a side view of the oral appliance system of FIG. 12A anchored to the teeth of a human jaw, with the jaw in a resting position.

Reference is now made to FIGS. 12A and 12B, which show a twelfth exemplary oral appliance system 1200. In FIGS. 12A and 12B, the same reference numerals are used to refer to features corresponding to features in the eleventh exemplary oral appliance system 1100, except with the prefix "12" instead of "11". The twelfth oral appliance system 1200 is substantially identical to the eleventh exemplary oral appliance system 1100 shown in FIGS. 11A and 11B, except that, analogously to the second exemplary oral appliance system shown in FIGS. 2A and 2B, the anterior maxillary magnets 1208 and posterior maxillary magnets 1210 are set into the maxillary facial sidewalls 1218 and the anterior mandibular magnets 1214 and the posterior mandibular magnets 1216 are set into the mandibular facial sidewalls 1224.

Figure 12C:
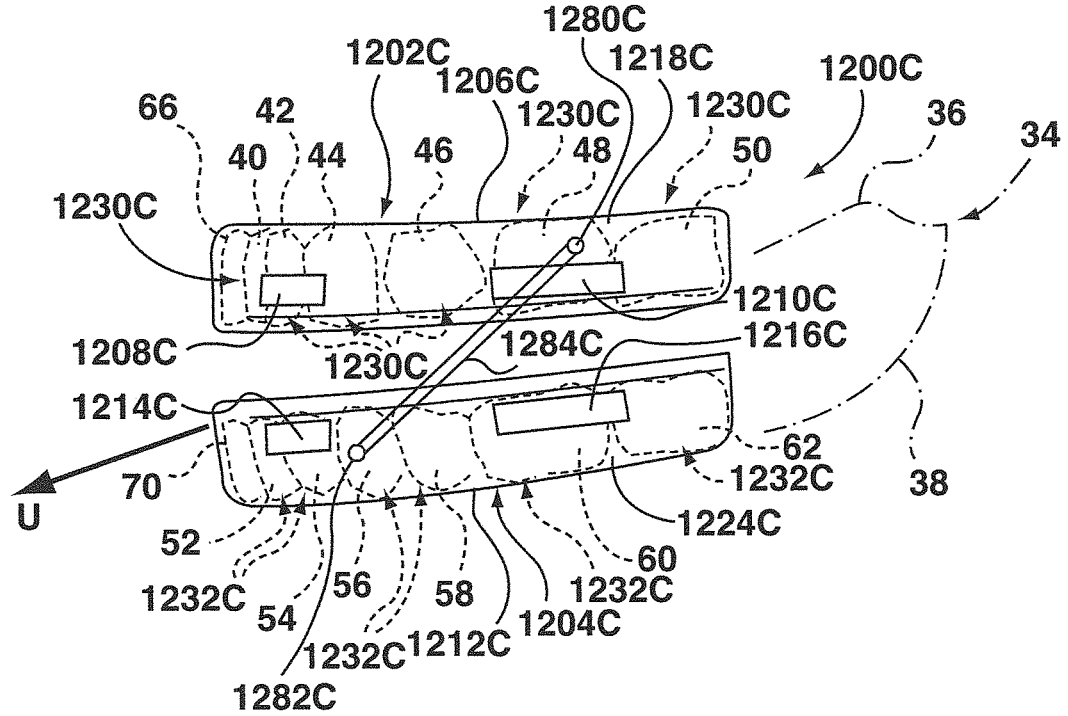
FIG. 12C is a side view showing a variant of the oral appliance system of FIG. 12A anchored to the teeth of a human jaw, with the jaw in a resting position.

FIG. 12C shows a variant 1200C of the twelfth oral appliance system 1200, with corresponding reference numerals used to refer to corresponding features, only with the suffix "C". The variant oral appliance system 1200C differs from the variant oral appliance 1100C shown in FIG. 11C in the same way that the twelfth oral appliance system 1200 differs from the eleventh oral appliance system 1100, that is, in the positioning of the magnets 1208, 1210, 1214 and 1216.

Figure 13A:
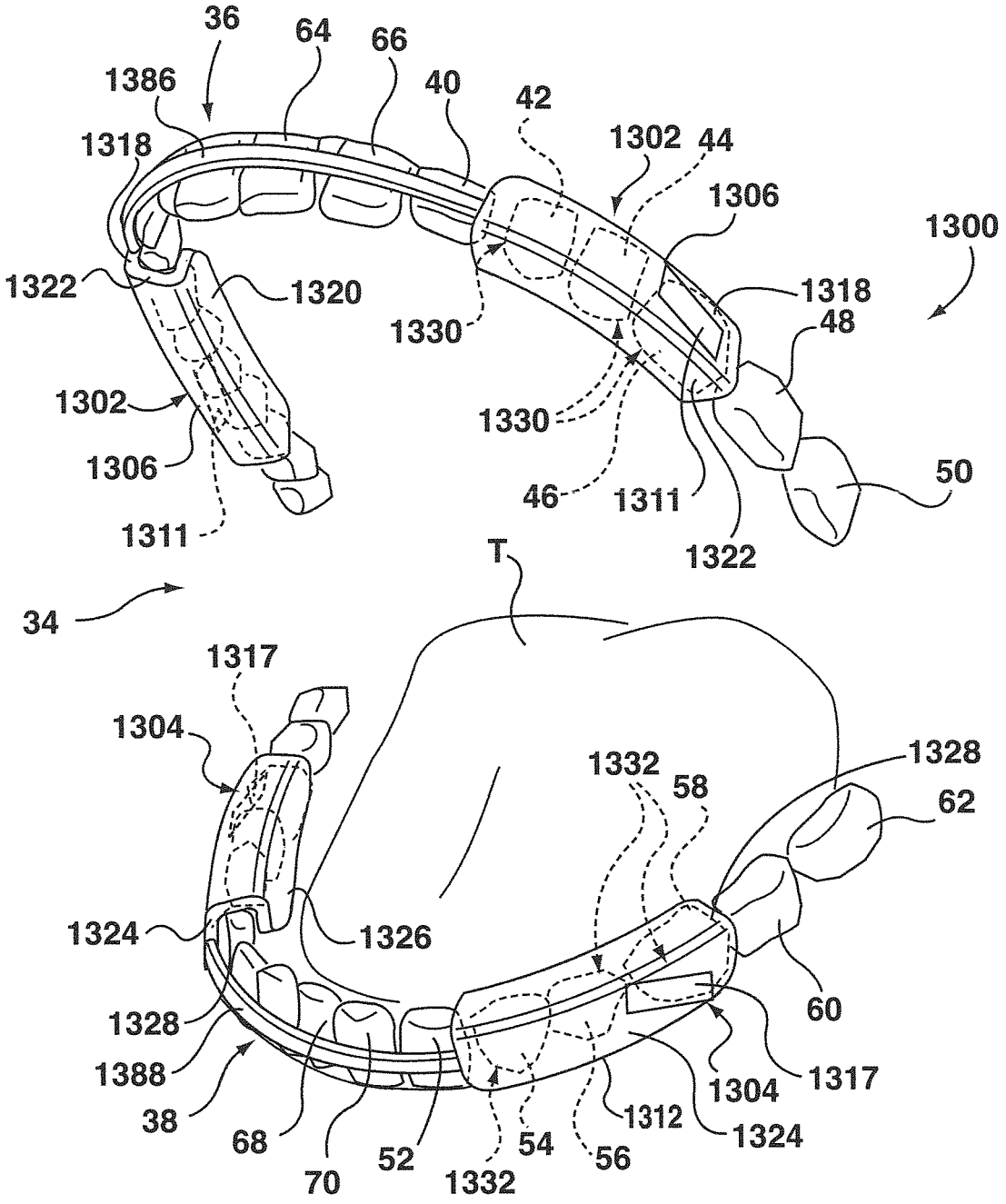
FIG. 13A is an upper front perspective view of a thirteenth exemplary oral appliance system anchored to the teeth of a human jaw, with the jaw in an exaggerated open position.
Figure 13B:
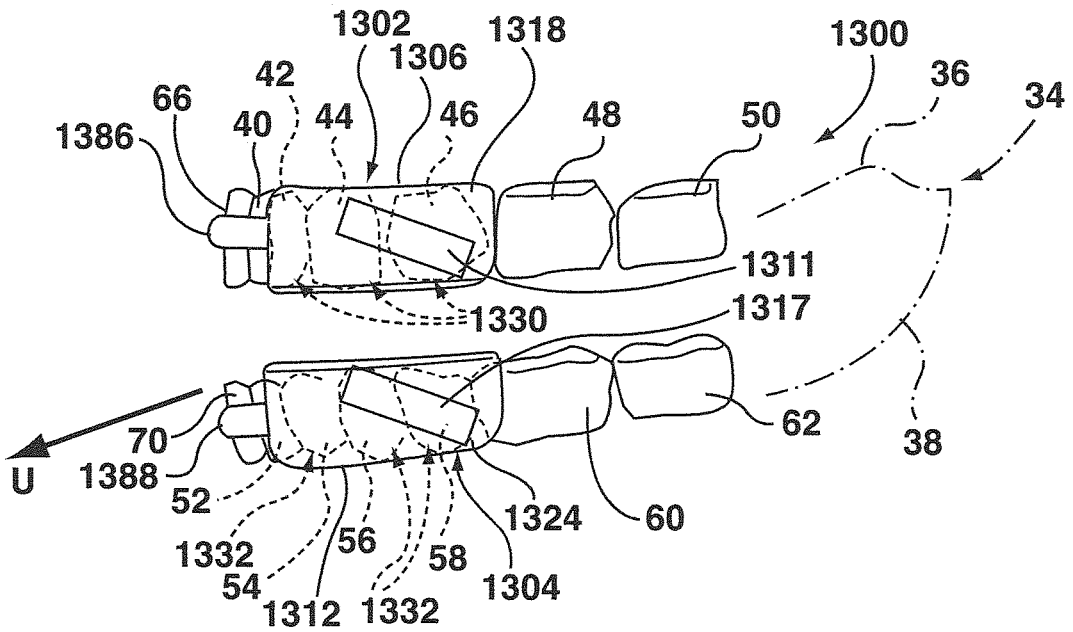
FIG. 13B is a side view of the oral appliance system of FIG. 13A anchored to the teeth of a human jaw, with the jaw in a resting position.

FIGS. 13A and 13B show a thirteenth exemplary oral appliance system that is substantially identical to the ninth exemplary oral appliance system shown in FIGS. 9A and 9B, except that the anterior maxillary magnets and posterior maxillary magnets have been replaced by a single maxillary magnet 1311 for each maxillary anchor portion 1306 and the anterior mandibular magnets and posterior mandibular magnets have been replaced by a single mandibular magnet 1317 for each mandibular anchor portion 1312. The maxillary magnets 1311 and mandibular magnets 1317 are angled relative to the maxillary anchor portions 1306 and mandibular anchor portions 1312 to urge the mandibular anchor portions 1312 away from and anteriorly relative to their respective corresponding maxillary anchor portions 1306.

Figure 13C:
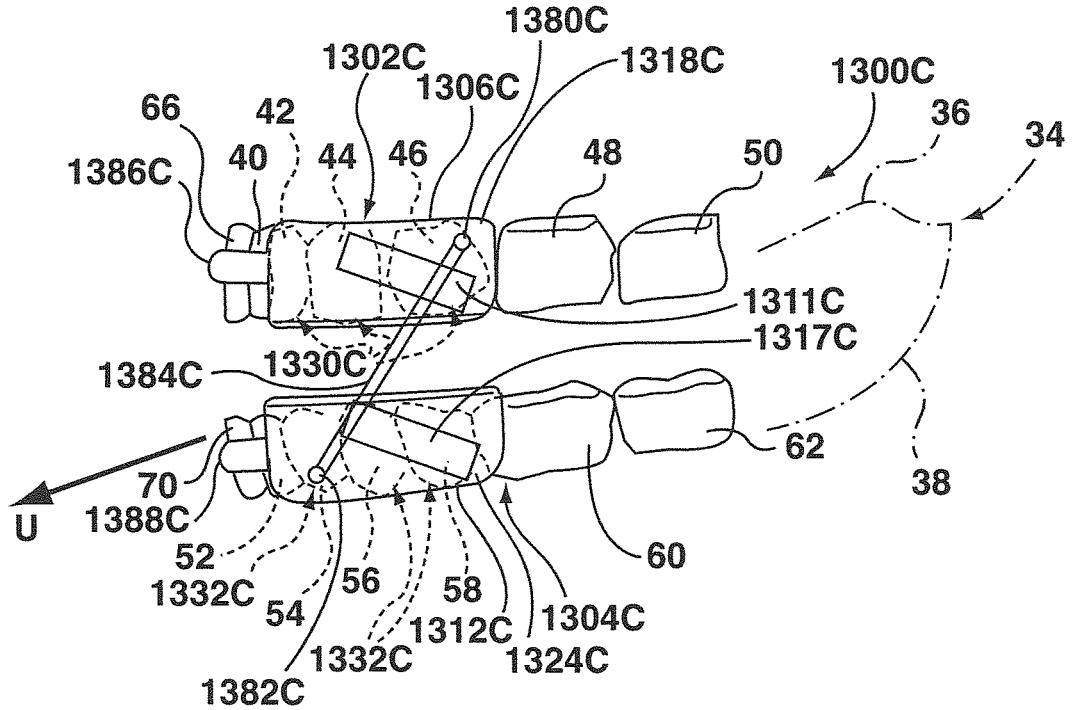
FIG. 13C is a side view showing a variant of the oral appliance system of FIG. 13A anchored to the teeth of a human jaw, with the jaw in a resting position.

FIG. 13C shows a variant 1300C of the thirteenth exemplary oral appliance system 1300, with identical reference numerals used to refer to features of the variant oral appliance system 1300C which correspond to features of the thirteenth oral appliance system 1300, but with the additional suffix "C". The variant oral appliance system 1300C differs from the thirteenth oral appliance system 1300 in that it includes maxillary tether mountings 1380C, mandibular tether mountings 1382C and tethers 1384C as described above.

Although the exemplary oral appliance systems described above have magnets placed in differing positions, the magnets are still arranged so that, when the oral appliance system is mounted on the jaw, repulsion between the maxillary magnets and the mandibular magnets urges each mandibular appliance inferiorly away from its corresponding maxillary appliance and also urges each mandibular appliance anteriorly relative to the corresponding maxillary appliance.

Figure 14:
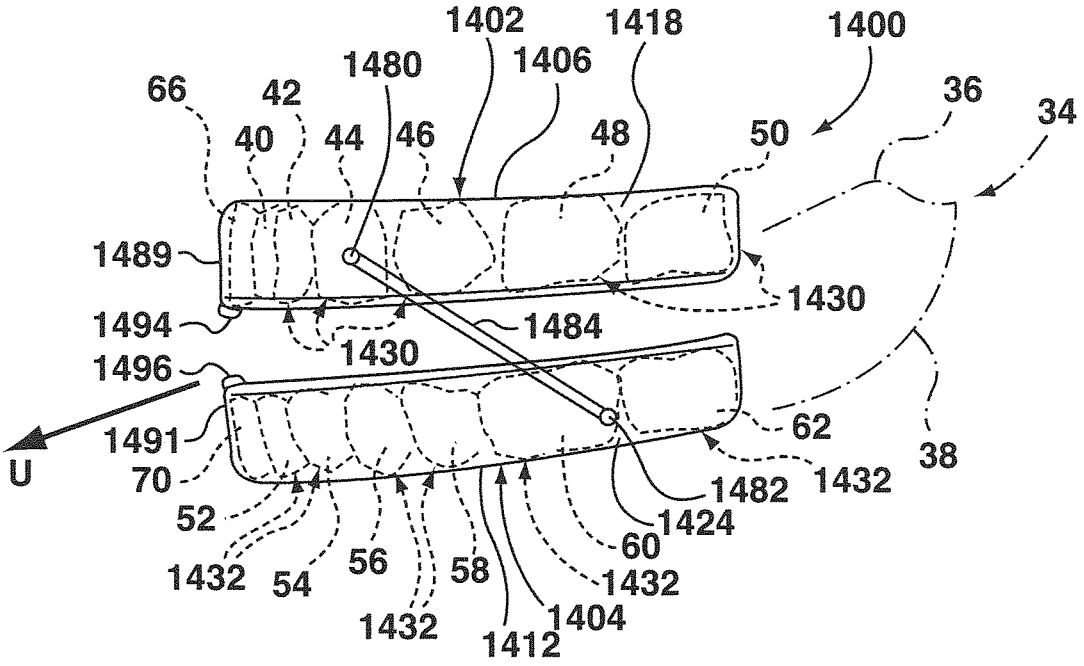
FIG. 14 is a side view of a fourteenth exemplary oral appliance system anchored to the teeth of a human jaw, with the jaw in a resting position.

FIG. 14 is a side view showing a fourteenth exemplary oral appliance system, indicated generally by reference numeral 1400. The oral appliance system 1400 shown in FIG. 14 is similar in structure to the eleventh and twelfth exemplary oral appliance systems 1100, 1200 shown in FIGS. 11A and 11B and FIGS. 12A and 12B, respectively, and comprises a single maxillary appliance 1402 and a single mandibular appliance 1404. Accordingly, corresponding reference numerals are used to refer to features of the oral appliance system 1400 in FIG. 14 that correspond to features of the eleventh and twelfth exemplary oral appliance systems 1100, 1200, except with the prefix "14". Unlike the eleventh and twelfth exemplary oral appliance systems 1100, 1200, and unlike the other exemplary embodiments shown in FIGS. 1A to 9C and 13A to 13C and in FIGS. 15A to 15C described below, each of which use only magnets as the biasing members, the oral appliance system 1400 shown in FIG. 14 uses both magnets and resilient tethers as biasing members.

Instead of anterior maxillary magnets and posterior maxillary magnets, the maxillary appliance 1402 has a single maxillary magnet 1494 positioned in registration with the maxillary central incisors (not shown in FIG. 14) or in registration with both the maxillary central incisors and the maxillary lateral incisors 66. Similarly, instead of anterior mandibular magnets and posterior mandibular magnets, the mandibular appliance 1404 has a single mandibular magnet 1496 in registration with the mandibular central incisors (not shown in FIG. 14) or in registration with both the mandibular central incisors and the mandibular lateral incisors 70. Alternatively, two or more spaced-apart maxillary magnets and/or two or more spaced apart mandibular magnets may be used.

In the oral appliance system 1400 shown in FIG. 14, the maxillary magnet 1494 and the mandibular magnet 1496 are arranged so that, when the oral appliance system 1400 is mounted on the jaw 34, repulsion between the maxillary magnet 1494 and the mandibular magnet 1496 urges the mandibular appliance 1404 inferiorly away the maxillary appliance 1402, but need not be arranged to urge the mandibular appliance 1404 anteriorly relative to the maxillary appliance 1402; this is accomplished by resilient tethers 1484 as described below.

The maxillary appliance 1402 has a pair of opposed maxillary tether mountings 1480 and the mandibular appliance 1404 has a pair of opposed mandibular tether mountings 1482, with each of the maxillary tether mountings 1480 also being opposed to a respective one of the mandibular tether mountings 1482 when the maxillary appliance 1402 is received on the teeth of the maxilla 36 and the mandibular appliance 1404 is received on the teeth of the mandible 38. Moreover, as shown in FIG. 14, when the maxillary appliance 1402 is received on the teeth of the maxilla 36 and the mandibular appliance 1404 is received on the teeth of the mandible 38, the mandibular tether mountings 1482 are positioned posteriorly of the maxillary tether mounting 1480. Resilient tethers 1484 are received at the maxillary tether mountings 1480 and the mandibular tether mountings 1482 and extend between the maxillary appliance 1402 and the mandibular appliance 1404. The tethers 1484 are selected so that their natural unstretched length is less than the distance between the opposed pairs of maxillary tether mountings 1480 and mandibular tether mountings 1482 when the maxillary appliance 1402 and the mandibular appliance 1404 are in registration with one another on a human jaw 34 as shown in FIG. 14. As a result, when the oral appliance system 1400 is mounted on the jaw 34 with the maxillary appliance 1402 and the mandibular appliance 1404 in registration with one another, the tethers 1484 will be in a stretched condition. Because the mandibular tether mountings 1482 are positioned posteriorly of the maxillary tether mountings 1480, when the maxillary appliance 1402 is anchored to the teeth of the maxilla 36 and the mandibular appliance 1404 is anchored to the teeth of the mandible 38, contraction of the tethers 1484 when the oral appliance system 1400 is mounted on the jaw 34 will urge the mandibular appliance 1404 inferiorly and anteriorly relative to the maxillary appliance 1402. Thus, the tethers 1484 are active tethers.

Each of the maxillary magnet 1494, the mandibular magnet 1496 and the resilient tethers 1484 is a biasing member, and when the oral appliance system 1400 is mounted on a human jaw 34, these biasing members cooperate with one another, acting between the maxillary appliance 1402 and the mandibular appliance 1404 to urge the mandibular appliance 1402 and the maxillary appliance 1404 away from one another and urge the mandibular appliance 1404 anteriorly relative to the maxillary appliance 1402. Specifically, repulsion between the maxillary magnet 1494 and the mandibular magnet 1496 urges the mandibular appliance 1404 inferiorly away the maxillary appliance 1402 while the stretched resilient tethers 1484 urge the mandibular appliance 1404 anteriorly relative to the maxillary appliance 1402. It should be noted here that the structure of the jaw 34, and in particular the pivotal linkage of the mandible 38 to the skull at the anterior end of the maxilla 36, inhibits the tethers 1484 from drawing the mandibular appliance 1404 toward the maxillary appliance posteriorly of the maxillary magnet 1494 and the mandibular magnet 1496.

It is also contemplated that there may be variants of the maxillary appliance 1402 shown in FIG. 14 in which the maxillary magnet and the mandibular magnet are omitted entirely, and in which the resilient tethers are the only biasing members. The resilient tethers will urge the mandibular appliance anteriorly and inferiorly relative to the maxillary appliance, even in the absence of other biasing members because the shape and mechanics of the human jaw redirect the forces applied by the tethers and guide the mandible anteriorly and slightly inferiorly. In particular, the condyle will progress inferiorly and anteriorly along the surface of the fossa under urging from the resilient tethers.

Although the embodiments thus far shown and described herein have included a greater number of mounting receptacles for increased anchoring strength, each maxillary anchor portion need only include mounting receptacles for securely removably receiving an M1 maxillary molar tooth and an adjacent PM2 maxillary premolar tooth, and each mandibular anchor portion need only include mounting receptacles for securely removably receiving an M1 mandibular molar tooth and an adjacent PM2 mandibular premolar tooth.

Figure 15A:
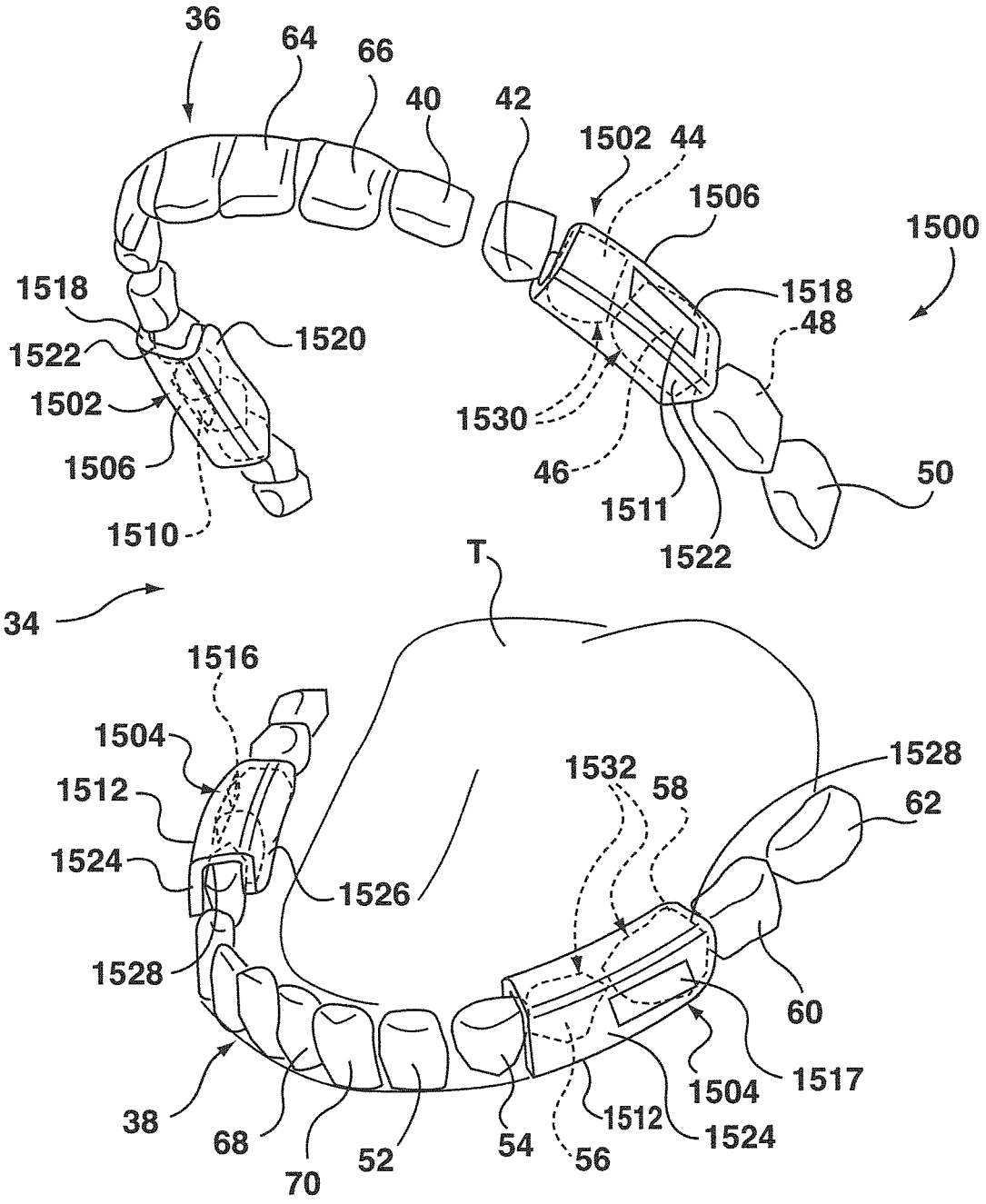
FIG. 15A is an upper front perspective view of a fifteenth exemplary oral appliance system anchored to the teeth of a human jaw, with the jaw in an exaggerated open position.
Figure 15B:
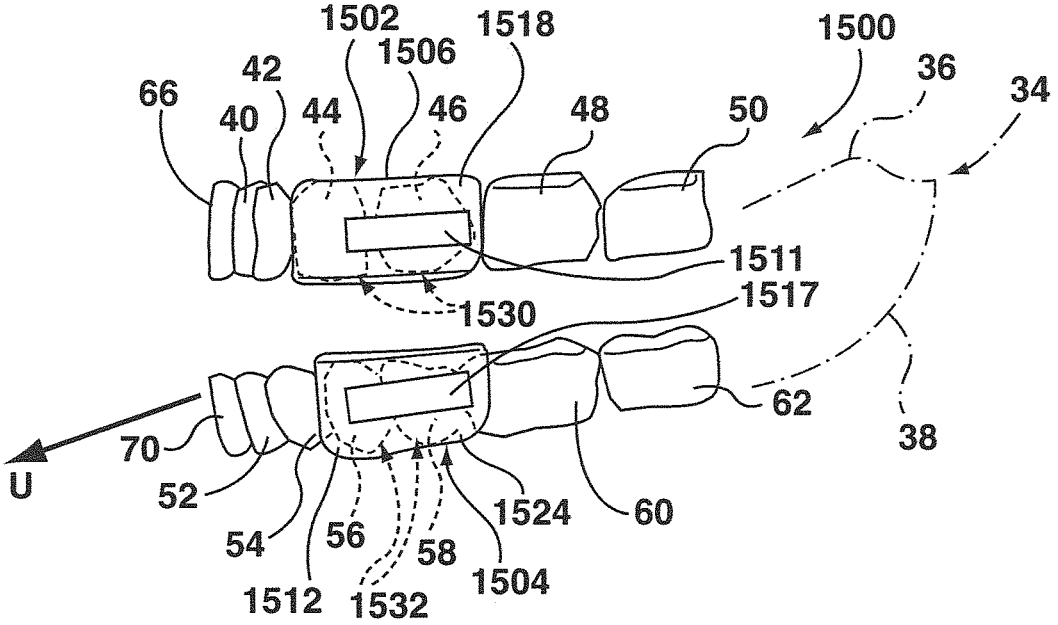
FIG. 15B is a side view of the oral appliance system of FIG. 15A anchored to the teeth of a human jaw, with the jaw in a resting position.
Figure 15C:
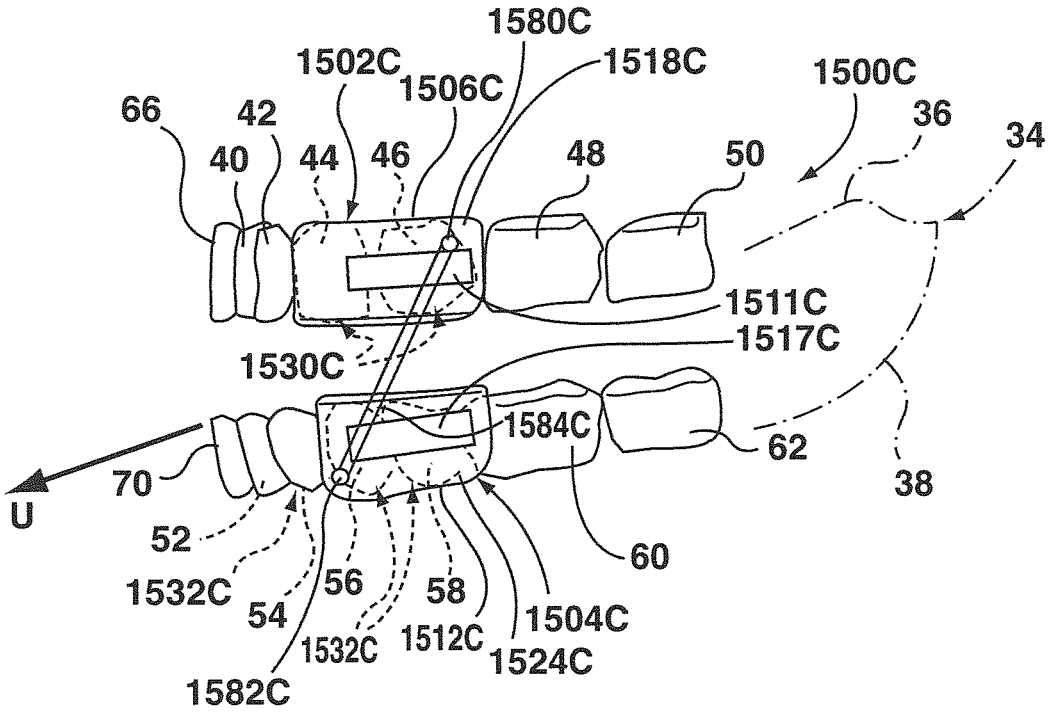
FIG. 15C is a side view showing a variant of the oral appliance system of FIG. 15A anchored to the teeth of a human jaw, with the jaw in a resting position.

FIGS. 15A and 15B show a fifteenth exemplary oral appliance system, denoted generally by reference 1500. Like reference numerals are used to refer to like features, except with the prefix "15" instead of "8". The fifteenth exemplary oral appliance system 1500 shown in FIGS. 15A and 15 is similar to the eighth exemplary oral appliance system 800 shown in FIGS. 8A and 8B, except that each maxillary anchor portion 1506 includes maxillary mounting receptacles 1530 for securely removably receiving only a maxillary second premolar (PM2) tooth 44 and a maxillary first molar (M1) tooth 46, and the mandibular anchor portions 1512 include mandibular mounting receptacles 1532 for securely removably receiving only a mandibular second premolar (PM2) tooth 56 and a mandibular first molar (M1) tooth 58. In addition, because the maxillary appliances 1502 and mandibular appliances 1504 of the fifteenth embodiment are shorter than those of the eighth embodiment, instead of both an anterior maxillary magnet and a posterior maxillary magnet, the maxillary appliances 1502 each have only a single maxillary magnet 1511 and the mandibular appliances 1504 each have only a single mandibular magnet 1517.

FIG. 15 shows a variant 1500C of the fifteenth exemplary oral appliance system 1500. The variant oral appliance system 1500C includes maxillary tether mountings 1580C, mandibular tether mountings 1582C and tethers 1584C, and the same reference numerals are used to refer to features of the variant oral appliance system 1500C that correspond to features of the fifteenth exemplary oral appliance system 1500, except with the suffix "C".

For each of the oral appliance systems described above, when the mandibular appliance (or appliances) are received on the human mandible and the maxillary appliance (or appliances) are received on the human maxilla of a common jaw, the respective biasing members act between the maxillary appliance(s) and the mandibular appliance(s) to urge the mandibular appliance(s) and the maxillary appliance(s) away from one another and to urge the mandibular appliance(s) anteriorly relative to the maxillary appliance(s). Preferably, the respective biasing members urge the mandibular appliance(s) and the maxillary appliance(s) away from one another with a force between about 250 grams at contact and 1200 grams at contact between the mandibular appliance(s) and the maxillary appliance(s), more preferably with a force of between about 250 and about 1000 grams at contact between the at least one mandibular appliance and the at least one maxillary appliance, and still more preferably with a force of between about 250 and about 900 grams at contact between the at least one mandibular appliance and the at least one maxillary appliance. For the embodiments shown in FIGS. 1A to 2C and 7A to 8C in which the respective oral appliance system comprises two separate maxillary appliances and two separate mandibular appliances, each opposed pair of maxillary and mandibular appliances will preferably repel each other with a force between about 125 grams at contact and 600 grams at contact between the mandibular appliance(s) and the maxillary appliance(s), more preferably with a force of between about 125 and about 500 grams at contact between the at least one mandibular appliance and the at least one maxillary appliance, and still more preferably with a force of between about 125 and about 450 grams at contact between the at least one mandibular appliance and the at least one maxillary appliance. Thus, the total repulsive force at contact for the complete oral appliance system is between about 250 grams at contact and about 1200 grams at contact between the mandibular appliances and the maxillary appliances, preferably between 250 and 1000 grams at contact and more preferably between about 250 and about 900 grams at contact.

Typically, the muscles of the human jaw will be strong enough to overpower the biasing members and close the jaw while wearing an oral appliance system as described herein. However, the biasing members will apply a braking force to the mandible as it closes, lessening the effect of any sudden impact. While embodiments such as those shown in FIGS. 11A to 12C and in FIG. 14 that encapsulate all of the teeth will provide maximum impact protection, maxillary appliances and mandibular appliances that do not encapsulate all the teeth, such as those shown in FIGS. 1A to 10C and in FIGS. 13A to 13C and 15A to 15C can be sized and shaped to engage one another prior to complete jaw closure so as to keep the nonencapsulated teeth separated in the event of a sudden jaw closure. When the magnets protrude from the maxillary occlusal web(s) mandibular anchor portions 112 of the maxillary appliance(s) and the mandibular occlusal web(s) of the mandibular appliance(s) rather than being recessed therein, they should be coated with a sufficient thickness of a suitable material to protect the magnets from being damaged by the impact of a rapid closure of the jaw. Such a coating will also inhibit any biologically adverse interaction between the magnets and the tissue of the mouth.

Because the respective biasing members urge the mandibular appliance(s) and the maxillary appliance(s) away from one another and urge the mandibular appliance(s) anteriorly relative to the maxillary appliance(s), when the jaw muscles are at rest the oral appliances described herein will urge the jaw into an open, mandible anterior position that improves breathing.

The mounting receptacles may be formed, for example, by taking a mold of an individual's teeth and then using that mold to form the mounting receptacles in the mandibular appliance(s) and maxillary appliance(s), as is known in the dental arts. Alternatively, the mandibular appliance(s) and maxillary appliance(s) may be made from a heat-pliable material provided with pre-formed cavities of a standardized shape. This will enable a dental professional, or an end consumer, to customize the mandibular appliance(s) and maxillary appliance(s) by heating the mandibular appliance(s) and maxillary appliance(s) to make them pliable and then pressing the teeth into the pre-formed cavities to form the receptacles, after which the mandibular appliance(s) and maxillary appliance(s) are allowed to cool and harden.

Figure 16:
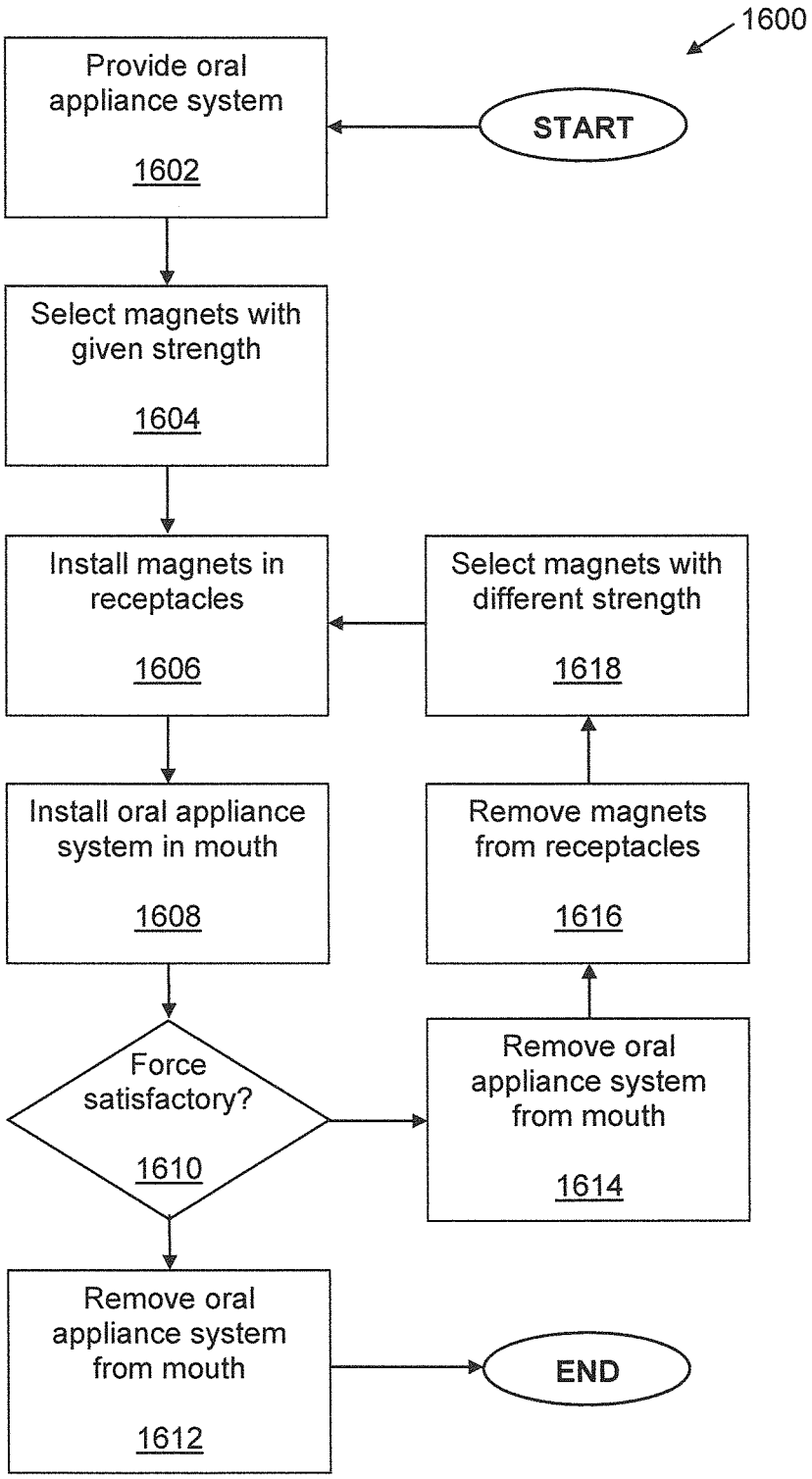
FIG. 16 is a flow chart showing an exemplary method for assembling an oral appliance system.

In addition, where magnets are used as the biasing members, the force with which the mandibular appliance(s) and maxillary appliance(s) repel one another can be customized by using magnets of different strengths. FIG. 16 is a flow chart showing an exemplary method 1600 for assembling an oral appliance system of the type shown and described above, once fitted to the individual's teeth. For example, a kit may include at least one maxillary appliance and at least one mandibular appliance each having respective magnet receptacles, together with magnets of varying strength.

At step 1602, an oral appliance system is provided, which includes respective magnet receptacles carried by the at least one maxillary appliance and the at least one mandibular appliance. At step 1604, magnets each having a given strength are selected and at step 1606, the selected magnets are installed in the respective magnet receptacles, for example by a dental professional or a consumer. At step 1608, the oral appliance system is installed in the mouth of a human person by anchoring the at least one mandibular appliance to the human person's mandible and anchoring the at least one maxillary appliance to the human person's maxilla so that the respective magnets act between the at least one maxillary appliance and the at least one mandibular appliance to urge the human person's mandible inferiorly and anteriorly away from the human person's maxilla with a force between about 250 grams at contact and about 1200 grams at contact. At step 1610, the method 1600 checks whether the force with which the respective magnets act between the at least one maxillary appliance and the at least one mandibular appliance is satisfactory, or is too strong or too weak. If the force is determined, for example by a dental professional or consumer, to be satisfactory, the method proceeds to step 1612, where the oral appliance system is removed, and then the method 1600 ends. If the force is determined to be unsatisfactory, the method proceeds to step 1614, at which the oral appliance system is removed, then to step 1616, at which the magnets are removed, then to step 1618, where magnets of different strength are selected, and then returns to step 1604, where the newly selected magnets are installed in the respective magnet receptacles.

Figure 17:
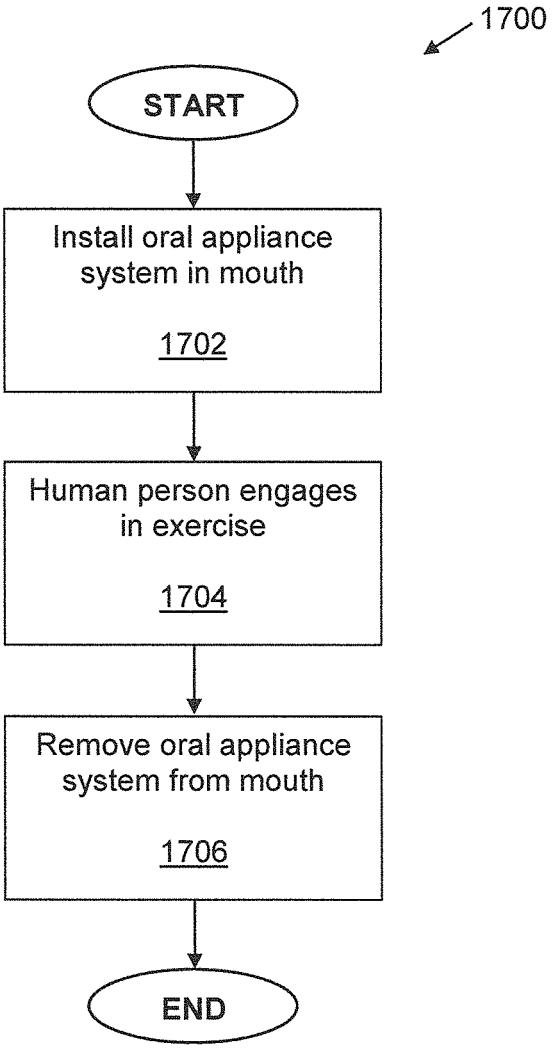
FIG. 17 is a flow chart showing an exemplary method of exercising by a human person.

As noted above, oral appliance systems as described above are intended for use in exercise applications, including sports, to position a human jaw for improved airway configuration to enhance breathing. Reference is now made to FIG. 17, which is a flow chart 1700 that shows an exemplary method of exercising by a human person.

At step 1702, an oral appliance system is installed in the human person's mouth. The oral appliance system may be any one of the oral appliance systems shown and described above. As such, the oral appliance system installed at step 1702 comprises at least one maxillary appliance and at least one mandibular appliance. Installing the oral appliance system at step 1702 comprises anchoring the at least one mandibular appliance to the human person's mandible and anchoring the at least one maxillary appliance to the human person's maxilla so that the respective biasing members act between the at least one maxillary appliance and the at least one mandibular appliance to urge the human person's mandible inferiorly and anteriorly away from the human person's maxilla with a force between about 250 grams at contact and about 1200 grams at contact.

At step 1704, after installing the oral appliance system, the human person engages in exercise. Examples types of exercise in which the human person may engage include field hockey, ice hockey, rugby, lacrosse, running, soccer, basketball, skating, yoga, skiing, snowboarding, martial arts, football, gymnastics, volleyball, racquet sports such as tennis, racquetball, squash and the like, athletic events such as shot-put, discus, hammer throw, javelin, long jump, high jump and the like, equine sports, weightlifting, rowing, bicycling, calisthenics, Pilates, climbing, elliptical training, stair training, as well as others. Oral appliance systems as described herein should not be used for exercise where impact to the jaw is expected, and instead a suitable protective mouthguard should be worn. For example, while oral appliance systems as described herein would be suitable for some types of martial arts training, such as where an individual is striking pads held by a partner but is not being struck, oral appliance systems as described herein should not be used in actual sparring or competition, for which a suitable protective mouthguard should be worn.

At step 1706, after completing the exercise, the human person removes the oral appliance system from his or her mouth.

The above description is intended in an illustrative rather than a restrictive sense. Variations to the exact embodiments described may be apparent to those skilled in the relevant art without departing from the scope of the claims set out below, and suitable features of individual exemplary embodiments may be combined with one another. For example, an embodiment similar to the fifteenth embodiment shown in FIGS. 15A and 15B may include anterior arch links. As another example, as long as the magnets and tether mountings are suitably positioned, an oral appliance system may comprise one or more maxillary appliances from one of the above-described embodiments in combination with one or more mandibular appliances from a different one of the above-described embodiments. Similarly, in the illustrative embodiments shown in the drawings described above, the quantity, positioning and angle of the magnets is merely exemplary, and the quantity, positioning and angle of the magnets may be varied as long as they continue to perform the required function. For instance, magnets may be set into both the occlusal web and the facial sidewall.

Several exemplary embodiments have been described by way of example. It will be apparent to persons skilled in the art that a number of variations and modifications can be made without departing from the scope of the claims.

What is claimed is:

1. An oral appliance system for a human mouth, comprising:

at least one maxillary appliance, comprising:

two maxillary anchor portions adapted to removably anchor the at least one maxillary appliance to a human maxilla at least at opposed posterior segments thereof;

each maxillary anchor portion including mounting receptacles adapted to securely removably receive at least an M1 maxillary molar tooth and an adjacent PM2 maxillary premolar tooth on one side of the human mouth;

at least one mandibular appliance comprising:

two mandibular anchor portions adapted to removably anchor the at least one mandibular appliance to a human mandible at least at opposed posterior segments thereof;

each mandibular anchor portion including mounting receptacles adapted to securely removably receive at least an M1 mandibular molar tooth and an adjacent PM2 mandibular premolar tooth on one side of the human mouth; and biasing members carried by the at least one maxillary appliance and the at least one mandibular appliance;

wherein the oral appliance system is configured so that, when the at least one mandibular appliance is removably anchored to the human mandible and the at least one maxillary appliance is removably anchored to the human maxilla of a common jaw, the biasing members act between the at least one maxillary appliance and the at least one mandibular appliance to urge the at least one mandibular appliance inferiorly and anteriorly away from the at least one maxillary appliance with a force between about 250 grams at contact between the at least one mandibular appliance and the at least one maxillary appliance and about 1200 grams at contact between the at least one mandibular appliance and the at least one maxillary appliance.

2. The oral appliance system of claim 1, wherein the biasing members comprise:

at least one maxillary magnet fixedly carried by the at least one maxillary appliance; and at least one mandibular magnet carried by the at least one mandibular appliance;

the at least one mandibular magnet and the at least one maxillary magnet are positioned so that, when the at least one mandibular appliance is removably anchored to the human mandible and the at least one maxillary appliance is removably anchored to the human maxilla of the common jaw, the at least one mandibular magnet and the at least one maxillary magnet repel one another.

3. The oral appliance system of claim 2, wherein the at least one mandibular magnet and the at least one maxillary magnet are positioned so that, when the at least one mandibular appliance is removably anchored to the human mandible and the at least one maxillary appliance is removably anchored to the human maxilla of the common jaw, repulsion between the at least one mandibular magnet and the at least one maxillary magnet urges the at least one mandibular appliance anteriorly relative to the at least one maxillary appliance.

4. The oral appliance system of claim 3, wherein:

each maxillary anchor portion has a maxillary tether mounting;

each mandibular anchor portion has a mandibular tether mounting;

the mandibular tether mountings positioned anteriorly of the maxillary tether mountings when the at least one mandibular appliance is removably anchored to the human mandible and the at least one maxillary appliance is removably anchored to the human maxilla of the common jaw;

each maxillary tether mounting opposed to a corresponding one of the mandibular tether mountings for receiving tethers to extend between each maxillary anchor portion and its corresponding mandibular anchor portion to limit movement of the at least one maxillary appliance and the at least one mandibular appliance away from one another.

5. The oral appliance system of claim 4, further comprising flexible tethers received at the maxillary tether mountings and the mandibular tether mountings and extending between each maxillary anchor portion and its corresponding mandibular anchor portion so as to limit movement of the at least one maxillary appliance and the at least one mandibular appliance away from one another.

6. The oral appliance system of claim 2, wherein:

each maxillary anchor portion has a maxillary tether mounting;

each mandibular anchor portion has a mandibular tether mounting;

the mandibular tether mountings positioned posteriorly of the maxillary tether mountings when the at least one mandibular appliance is removably anchored to the human mandible and the at least one maxillary appliance is removably anchored to the human maxilla of the common jaw;

each maxillary tether mounting opposed to a corresponding one of the mandibular tether mountings for receiving tethers to extend between each maxillary anchor portion and its corresponding mandibular anchor portion to urge the at least one mandibular appliance anteriorly relative to the at least one maxillary appliance.

7. The oral appliance system of claim 6, wherein the biasing members further comprise resilient tethers received at the maxillary tether mountings and the mandibular tether mountings and extending between each maxillary anchor portion and its corresponding mandibular anchor portion so as to urge the at least one mandibular appliance anteriorly relative to the at least one maxillary appliance when the at least one mandibular appliance is anchored to the human mandible and the at least one maxillary appliance is anchored to the human maxilla of the common jaw.

8. The oral appliance system of claim 1, wherein:

the at least one maxillary appliance comprises a single maxillary appliance, the single maxillary appliance comprising the pair of opposed maxillary anchor portions connected to one another by a maxillary anterior arch link; and the at least one mandibular appliance comprises a single mandibular appliance, the single mandibular appliance comprising the pair of opposed mandibular anchor portions connected to one another by a mandibular anterior arch link.

9. The oral appliance system of claim 8, wherein:

the maxillary anterior arch link is a lingual-side maxillary anterior arch link; and the mandibular anterior arch link is a lingual-side mandibular anterior arch link.

10. The oral appliance system of claim 8, wherein:

the maxillary anterior arch link is a labial-side maxillary anterior arch link; and the mandibular anterior arch link is a labial-side mandibular anterior arch link.

11. The oral appliance system of claim 8, wherein the maxillary anterior arch link and the mandibular anterior arch link are each channel-shaped so as to be adapted to receive incisors therewithin.

12. The oral appliance system of claim 1, wherein:

each maxillary anchor portion further includes an additional mounting receptacle adapted to securely removably receive a PM1 maxillary premolar tooth on one side of the human mouth; and each mandibular anchor portion further includes an additional mounting receptacle adapted to securely removably receive a PM1 mandibular premolar tooth on one side of the human mouth.

13. The oral appliance system of claim 12, wherein:

each maxillary anchor portion further includes an additional mounting receptacle adapted to securely removably receive a maxillary canine tooth on one side of the human mouth; and each mandibular anchor portion further includes an additional mounting receptacle adapted to securely removably receive a mandibular canine tooth on one side of the human mouth.

14. The oral appliance system of claim 1, wherein:

each maxillary anchor portion further includes an additional mounting receptacle adapted to securely removably receive an M2 maxillary molar tooth on one side of the human mouth; and each mandibular anchor portion further includes an additional mounting receptacle adapted to securely removably receive an M2 mandibular molar tooth on one side of the human mouth.

15. The oral appliance system of claim 14 wherein:

each maxillary anchor portion further includes an additional mounting receptacle adapted to securely removably receive an M3 maxillary molar tooth on one side of the human mouth; and each mandibular anchor portion further includes an additional mounting receptacle adapted to securely removably receive an M3 mandibular molar tooth on one side of the human mouth.

16. The oral appliance system of claim 1, wherein the biasing members urge the at least one mandibular appliance inferiorly and anteriorly away from the at least one maxillary appliance with a force between about 250 grams at contact between the at least one mandibular appliance and the at least one maxillary appliance and about 1000 grams at contact between the at least one mandibular appliance and the at least one maxillary appliance.

17. The oral appliance system of claim 1 or 16, wherein the at least one mandibular appliance and the at least one maxillary appliance are urged away from one another with a force of between about 250 grams at contact between the at least one mandibular appliance and the at least one maxillary appliance and about 900 grams at contact between the at least one mandibular appliance and the at least one maxillary appliance.

18. The oral appliance system of claim 1, wherein:

the at least one maxillary appliance comprises two separate maxillary appliances unconnected to one another, such that each maxillary anchor portion is distinct and part of a respective separate maxillary appliance; and the at least one mandibular appliance comprises two separate mandibular appliances unconnected to one another, such that each mandibular anchor portion is distinct and part of a respective separate mandibular appliance.

19. A method of exercising by a human person, comprising:

the human person installing in the human person's mouth an oral appliance system, the oral appliance system comprising:

at least one maxillary appliance, comprising:

two maxillary anchor portions for removably anchoring the at least one maxillary appliance to a human maxilla at least at opposed posterior segments thereof;

each maxillary anchor portion including mounting receptacles for securely removably receiving at least an M1 maxillary molar tooth and an adjacent PM2 maxillary premolar tooth on one side of the human mouth;

at least one mandibular appliance comprising:

two mandibular anchor portions for removably anchoring the at least one mandibular appliance to a human maxilla at least at opposed posterior segments thereof;

each mandibular anchor portion including mounting receptacles for securely removably receiving at least an M1 mandibular molar tooth and an adjacent PM2 mandibular premolar tooth on one side of the human mouth; and respective biasing members carried by the at least one maxillary appliance and the at least one mandibular appliance;

wherein installing the oral appliance system comprises anchoring the at least one mandibular appliance to the human person's mandible and anchoring the at least one maxillary appliance to the human person's maxilla so that the respective biasing members act between the at least one maxillary appliance and the at least one mandibular appliance to urge the human person's mandible inferiorly and anteriorly away from the human person's maxilla with a force between about 250 grams at contact between the at least one mandibular appliance and the at least one maxillary appliance and about 1200 grams at contact between the at least one mandibular appliance and the at least one maxillary appliance;

after installing the oral appliance system, the human person engaging in exercise selected from the group consisting of field hockey, ice hockey, rugby, lacrosse, running, soccer, basketball, skating, yoga, skiing, snowboarding, martial arts, football, gymnastics, volleyball, racquet sports, athletic events, equine sports, weightlifting, rowing, bicycling, calisthenics, Pilates, climbing, elliptical training, and stair training; and after completing the exercise, the human person removing the oral appliance system from the human person's mouth.

20. A method for assembling an oral appliance system in a human person, comprising:

providing the oral appliance system;

the oral appliance system comprising:

at least one maxillary appliance, comprising:

two maxillary anchor portions for removably anchoring the at least one maxillary appliance to a human maxilla at least at opposed posterior segments thereof;

each maxillary anchor portion including mounting receptacles for securely removably receiving at least an M1 maxillary molar tooth and an adjacent PM2 maxillary premolar tooth on one side of the human mouth;

at least one mandibular appliance comprising:

two mandibular anchor portions for removably anchoring the at least one mandibular appliance to a human maxilla at least at opposed posterior segments thereof;

each mandibular anchor portion including mounting receptacles for securely removably receiving at least an M1 mandibular molar tooth and an adjacent PM2 mandibular premolar tooth on one side of the human mouth; and respective magnet receptacles carried by the at least one maxillary appliance and the at least one mandibular appliance;

installing magnets in the respective magnet receptacles; and installing the oral appliance system in the mouth of the human person, wherein installing the oral appliance system comprises anchoring the at least one mandibular appliance to the human person's mandible and anchoring the at least one maxillary appliance to the human person's maxilla so that the respective magnets act between the at least one maxillary appliance and the at least one mandibular appliance to urge the human person's mandible inferiorly and anteriorly away from the human person's maxilla with a force between about 250 grams at contact between the at least one mandibular appliance and the at least one m axillary appliance and about 1200 grams at contact between the at least one mandibular appliance and the at least one maxillary appliance.

* * * * *